US008110326B2

(12) United States Patent
Shimada

(10) Patent No.: US 8,110,326 B2
(45) Date of Patent: Feb. 7, 2012

(54) ELECTROPHOTOGRAPHIC PHOTORECEPTOR, IMAGE FORMING APPARATUS, AND PROCESS CARTRIDGE

(75) Inventor: Tomoyuki Shimada, Shizuoka (JP)

(73) Assignee: Ricoh Company Limited, Tokyo (JP)

( * ) Notice: Subject to any disclaimer, the term of this patent is extended or adjusted under 35 U.S.C. 154(b) by 916 days.

(21) Appl. No.: 12/132,026

(22) Filed: Jun. 3, 2008

(65) Prior Publication Data

US 2008/0298840 A1 Dec. 4, 2008

(30) Foreign Application Priority Data

Jun. 4, 2007 (JP) ..... 2007-147718
Apr. 30, 2008 (JP) ..... 2008-118020

(51) Int. Cl.
*G03G 5/00* (2006.01)

(52) U.S. Cl. ..... 430/58.5; 399/159

(58) Field of Classification Search ..... 430/58.5; 399/159

See application file for complete search history.

(56) References Cited

U.S. PATENT DOCUMENTS

| | | | | |
|---|---|---|---|---|
| 3,816,118 | A | 6/1974 | Byrne | |
| 4,992,349 | A * | 2/1991 | Chen et al. | 430/58.5 |
| 2004/0096761 | A1* | 5/2004 | Lin et al. | 430/58.15 |
| 2005/0003286 | A1* | 1/2005 | Kim et al. | 430/58.5 |
| 2005/0112482 | A1* | 5/2005 | Kim et al. | 430/58.5 |
| 2007/0059039 | A1* | 3/2007 | Shimoyama et al. | 399/159 |

FOREIGN PATENT DOCUMENTS

| | | |
|---|---|---|
| DE | 1230031 | 6/1964 |
| EP | 1 736 476 A1 | 12/2006 |
| JP | 52-36016 | 9/1977 |
| JP | 53-95033 | 8/1978 |
| JP | 53-132347 | 11/1978 |
| JP | 53-133445 | 11/1978 |
| JP | 54-2129 | 1/1979 |
| JP | 54-12742 | 1/1979 |
| JP | 54-14967 | 2/1979 |
| JP | 54-17733 | 2/1979 |
| JP | 54-21728 | 2/1979 |
| JP | 54-22834 | 2/1979 |
| JP | 60-196768 | 10/1985 |
| JP | 64-17066 | 1/1989 |
| JP | 2732697 | 12/1997 |
| JP | 11-21466 | 1/1999 |
| JP | 2884353 | 2/1999 |
| JP | 2000-231204 | 8/2000 |
| JP | 2001-19871 | 1/2001 |
| JP | 2004-258253 | 9/2004 |
| WO | WO 02/40479 A1 | 5/2002 |

OTHER PUBLICATIONS

A. Itami, et al., "The Effects of Nitrogen Oxide on the Resolution of Organic Photoconductors", Konica Technical Report, vol. 13, 2000, pp. 37-40.

(Continued)

*Primary Examiner* — Mark Chapman
(74) *Attorney, Agent, or Firm* — Oblon, Spivak, McClelland, Maier & Neustadt, L.L.P.

(57) ABSTRACT

An electrophotographic photoreceptor including a conductive substrate and a photosensitive layer located overlying the conductive substrate which includes a naphthalenetetracarboxylic acid diimide derivative having a specific formula; and an image forming apparatus and a process cartridge using the electrophotographic photoreceptor are provided.

20 Claims, 11 Drawing Sheets

OTHER PUBLICATIONS

Abstract "(1B4 04) New Polymorphs of Chlorogallium Phthalocyanine and Their Photogenerating Properties", presented by Iijima, et al. in the 67$^{th}$ Annual meeting of the Chemical Society of Japan in 1994.

Abstract "(1B4 04) New Polymorphs of Chlorogallium Phthalocyanine and Their Photogenerating Properties", presented by Iijima, et al. in the 67$^{th}$ Annual meeting of the Chemical Society of Japan in 1994 (Abstract Only).

* cited by examiner

ELECTROPHOTOGRAPHIC PHOTORECEPTOR, IMAGE FORMING APPARATUS, AND PROCESS CARTRIDGE

BACKGROUND OF THE INVENTION

1. Field of the Invention

The present invention relates to an electrophotographic photoreceptor. In addition, the present invention relates to an image forming apparatus and a process cartridge using the electrophotographic photoreceptor.

2. Discussion of the Background

Information processing systems using electrophotography are making remarkable progress recently. Particularly, laser printers and digital copiers, in which information is converted into digital signals and recorded by means of light, have been extremely improved in terms of printing quality and reliability. Further, technologies used in these laser printers and digital copiers are applied to laser printers and digital copiers capable of printing full-color images by merging with high-speed printing technologies. For the above reasons, photoreceptors used for such laser printers and digital copiers are required both to produce high quality images and to have high durability.

Photoreceptors using organic photoconductive materials (hereinafter "organic photoreceptors" or "photoreceptors", unless otherwise described) are widely used for laser printers and digital copiers using electrophotography, due to their cost, manufacturability, and non-polluting properties. The organic photoreceptors are generally classified into single-layer photoreceptors and functionally-separated multilayer photoreceptors. The first practical organic photoreceptor, i.e., PVK-TNF charge-transfer complex photoreceptor was a member of the former single-layer photoreceptors.

In 1968, Hayashi and Regensburger independently invented PVK/a-Se multilayer photoreceptors. In 1977, Melts, and in 1978, Schlosser disclosed multilayer photoreceptors whose photosensitive layers, i.e., an organic pigment dispersed layer and an organic low-molecular-weight material dispersed layer, were all formed from organic material. These are known as functionally-separated multilayer photoreceptors because of having a charge generation layer (CGL) generating a charge by absorbing light and a charge transport layer (CTL) injecting and transporting the charge generated in the CGL and neutralizing charge on a surface of the photoreceptor.

However, the photosensitive layers of the organic photoreceptors are easily abraded by repeated use, and therefore the potential and photosensitivity of the photoreceptor tend to deteriorate. Further, a scratch made on the surface of the photoreceptor tends to cause background fouling and deterioration of density and quality of the resultant images. Therefore, improvement of abrasion resistance of the organic photoreceptors has been an important subject. Further, improvement of durability of the organic photoreceptors has become a more important subject recently, in accordance with speeding up of the printing speed and downsizing of an image forming apparatus attended with reduction of the diameter of the photoreceptor.

As a method of improving the abrasion resistance of the photoreceptor, methods of imparting lubricity to the photosensitive layer, hardening the photosensitive layer, including a filler therein, and using a high-molecular-weight charge transport material instead of a low-molecular-weight charge transport material are widely known. However, another problem occurs when these methods are used to prevent the abrasion of the photoreceptor. Specifically, oxidized gases, such as ozone and NOx arising due to use conditions or environment, adhere to the surface of the photosensitive layer and decrease the surface resistance thereof, resulting in a problem such as blurring of the resultant images. So far, such a problem has been avoided to some extent because the substances causing the blurred images are gradually scraped off in accordance with the abrasion of the photosensitive layer.

However, in order to comply with the above-described recent demand for higher sensitivity and durability of the photoreceptor, a new technique has been needed. In order to decrease the influence of substances causing the blurred images, there is a method of equipping the photoreceptor with a heater, which is a large drawback for downsizing the apparatus and decreasing the electric power consumption. In addition, a method of including an additive such as an antioxidant in the photosensitive layer is effective. However, the additive typically does not have photoconductivity, and therefore including much amount thereof in the photosensitive layer causes problems such as deterioration of sensitivity and increase of residual potential of the resultant photoreceptor.

As mentioned above, the photoreceptor tends not to be abraded by being given high abrasion resistance or properly process-designing around thereof. However, such photoreceptors inevitably produce blurred and low-resolution images, and it is difficult to achieve both high durability and high quality of the resultant images. The problem lies in a contradictory fact that high surface resistance of the photosensitive layer is preferable to prevent the blurred images and low surface resistance thereof is preferable to prevent the increase of residual potential.

Most practical photoreceptors are functionally-separated multilayer photoreceptors in which a charge generation layer and a charge transport layer are overlaid on a conductive substrate. The charge transport layer typically includes a hole transport material as a charge transport material. Such a photoreceptor is typically negatively chargeable.

Most copiers and printers employ corona discharge, which is a highly reliable charging method in electrophotography. However, as is generally known, negative corona discharge is unstable compared to positive corona discharge. Therefore, scorotron discharge, which is costly, is preferably employed, resulting in increasing cost. Negative corona discharge produces a large amount of ozone, which is a substance causing chemical damage. The ozone thus produced oxidizes and deteriorates a binder resin and a charge transport material. Further, ionic substances such as a nitrogen oxide ion, a sulfur oxide ion, and ammonium ion are also produced by negative corona discharge, and accumulate on the surface of the photoreceptor. Consequently, the resultant images have low image quality. In order to prevent the ozone from discharging out of the apparatus, most copiers and printers employing a negative charging method are equipped with an ozone filter, resulting in cost rise. Furthermore, the large amount of ozone thus produced causes environmental pollution.

To overcome the above-described drawbacks of negatively chargeable photoreceptors, positively chargeable photoreceptors have been proposed. A positively chargeable photoreceptor produces less ozone and nitrogen oxide ion. Moreover, a combination of a typical two-component developer with a positively chargeable photoreceptor can stably provide high quality images regardless of environmental conditions.

In a positively chargeable single-layer photoreceptor or a positively chargeable reverse multilayer photoreceptor, in which a charge generation layer is located on the outermost surface of the photoreceptor, a charge generation material is exposed at or located near the surface of the photoreceptor. Such photoreceptors have a drawback that properties thereof largely vary due to environmental gases such as exhausts from kerosene fan heaters or cars.

On the other hand, high-speed copying processes prefer negatively chargeable photoreceptors to positively chargeable photoreceptors. This is because most organic materials applicable to the practical high-speed copying processes have only hole transportability. In other words, only hole transport materials have been put to practical use. A normal multilayer photoreceptor, in which a charge transport layer including the hole transport material is located on the outermost surface of the photoreceptor, is typically negatively chargeable in principle.

If a photoreceptor is both positively and negatively chargeable, the photoreceptor may be widely applied to various fields, resulting in reduction of species of photoreceptors. Accordingly, cost may be reduced and high-speed printing may be advantageously achieved.

Japanese Patent No. (hereinafter JP) 2732697 discloses a bichargeable electrophotographic photoreceptor capable of being charged to both negative and positive polarities. The photoreceptor includes a diphenoquinone derivative as an electron transport material, but the diphenoquinone derivative has relatively low charge transportability. Therefore, photoconductive properties of the photoreceptor are not satisfactory enough in consideration of increasing printing speed and downsizing of copiers and printers. In addition, the photoreceptor may cause blurred images by repeated use.

Unexamined Japanese Application Publication No. (hereinafter JP-A) 2000-231204 discloses an electrophotographic photoreceptor including an aromatic compound having a dialkylamino group as an acid scavenger. The use of the aromatic compound provides high image quality even after the photoreceptor is repeatedly used. However, the aromatic compound has low charge transportability, and therefore the photoreceptor may not respond to the demands for high-sensitivity and high-speed printing. The added amount of the aromatic compound may be also limited.

JP-A 60-196768 and JP 2884353 have disclosed electrophotographic photoreceptors including a stilbene compound having a dialkylamino group. A reference entitled "The Effects of Nitrogen Oxide on the Resolution of Organic Photoconductors, A. Itami et al., Konica Technical Report Vol. 13 (2000)" describes that these stilbene compounds having a dialkylamino group have resistance to oxidized gases which cause image blurring.

Since the dialkylamino group, which is a substituent having a strong mesomerism effect (i.e., +M effect), is included in a resonance site of a triarylamine group structure, which is an electron transport site, the stilbene compound has an extremely small ionization potential. If such a stilbene compound is solely included in a photosensitive layer as a hole transport material, the photosensitive layer may potentially have poor charge retention ability or the charge retention ability may gradually deteriorate by repeated use. Therefore, a fatal problem lies in the fact that the stilbene compounds are difficult to be put into practical use. Even if the stilbene compound is used in combination with other charge transport material, the stilbene compound may become a hole-trapping site for moving charges because of having an extremely small ionization potential. Consequently, the resultant photoreceptor may have extremely low sensitivity and large residual potential.

JP-A 2004-258253 discloses an electrophotographic photoreceptor including a stilbene compound and a specific diamine compound in combination. The photoreceptor has an improved resistance to oxidized gases even after repeated use without decreasing sensitivity. However, high-speed printing and downsizing of the apparatus along with reducing the diameter of the photoreceptor have not realized with the photoreceptor.

German Patent No. 1230031 discloses a naphthalenetetracarboxylic acid diimide derivative used as an acceptor for formation of a charge-transfer complex. International Patent Application Publication No. 2002040479 also discloses a naphthalenetetracarboxylic acid diimide derivative pharmaceutically used as an anti-helicobacterial agent. However, use of these naphthalenetetracarboxylic acid diimide derivatives for electrophotographic photoreceptors is not mentioned at all.

SUMMARY OF THE INVENTION

Accordingly, an object of the present invention is to provide an electrophotographic photoreceptor which has high sensitivity and durability and capable of producing high quality images for a long period of time.

Another object of the present invention is to provide an image forming apparatus which is compact in size and capable of high-speed printing.

Yet another object of the present invention is to provide a process cartridge which realizes easy replacement of the electrophotographic photoreceptor.

These and other objects of the present invention, either individually or in combinations thereof, as hereinafter will become more readily apparent can be attained by an electrophotographic photoreceptor, comprising:

a conductive substrate; and a photosensitive layer located overlying the conductive substrate, comprising a naphthalenetetracarboxylic acid diimide derivative having the following formula (1):

(1)

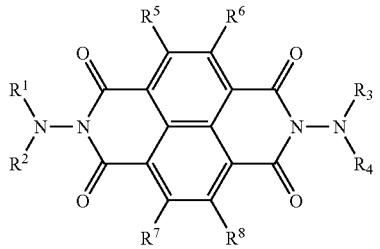

wherein each of $R^1$, $R^2$, $R^3$, and $R^4$ independently represents a substituted or unsubstituted alkyl group or a substituted or unsubstituted aromatic hydrocarbon group; each of $R^5$, $R^6$, $R^7$, and $R^8$ independently represents a hydrogen atom, a substituted or unsubstituted alkyl group, or a substituted or unsubstituted aromatic hydrocarbon group; $R^1$ and $R^2$ may optionally share bond connectivity to form a substituted or unsubstituted heterocyclic group containing a nitrogen atom; and $R^3$ and $R^4$ may optionally share bond connectivity to form a substituted or unsubstituted heterocyclic group containing a nitrogen atom; and an image forming apparatus and a process cartridge using the electrophotographic photoreceptor.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
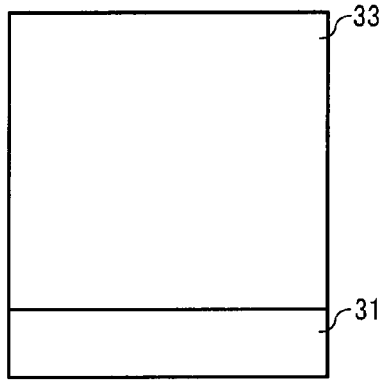
FIGS. 1 to 6 are schematic cross-sectional views illustrating embodiments of electrophotographic photoreceptors of the present invention.

Generally, the present invention provides an electrophotographic photoreceptor comprising a photosensitive layer comprising a naphthalenetetracarboxylic acid diimide derivative having the following formula (1):

(1)

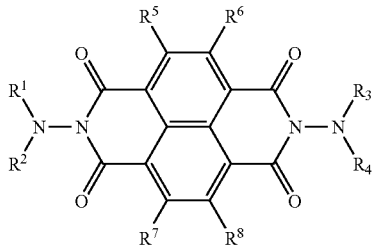

wherein each of $R^1$, $R^2$, $R^3$, and $R^4$ independently represents a substituted or unsubstituted alkyl group or a substituted or unsubstituted aromatic hydrocarbon group; each of $R^5$, $R^6$, $R^7$, and $R^8$ independently represents a hydrogen atom, a substituted or unsubstituted alkyl group, or a substituted or unsubstituted aromatic hydrocarbon group; $R^1$ and $R^2$ may optionally share bond connectivity to form a substituted or unsubstituted heterocyclic group containing a nitrogen atom; and $R^3$ and $R^4$ may optionally share bond connectivity to form a substituted or unsubstituted heterocyclic group containing a nitrogen atom.

The present inventors found that the above-described photoreceptor has resistance to substances (e.g., oxidizing gases) causing image blurring, and is chargeable to both positive and negative polarities.

The reason why the naphthalenetetracarboxylic acid diimide derivative is effective for maintaining the resultant image quality has not become clear yet, and while the present inventors do not wish to be bound to a specific mechanism of action for how it works, it is considered that the amino group, which is a strong basic group, included in the chemical structure thereof electrically neutralizes oxidizing gases which cause image blurring.

The naphthalenetetracarboxylic acid diimide derivative further improves sensitivity and stability in repeated use of the resultant photoreceptor, when used in combination with other charge transport material.

The naphthalenetetracarboxylic acid diimide derivative is an electron transport material. Therefore, a single-layer photoreceptor chargeable to both positive and negative polarities may be provided by including both the naphthalenetetracarboxylic acid diimide derivative and a hole transport material.

The naphthalenetetracarboxylic acid diimide derivative having the formula (1) will be explained in detail.

The naphthalenetetracarboxylic acid diimide derivative having the formula (1) can be manufactured by reacting a naphthalene-1,4,5,8-tetracarboxylic acid dianhydride derivative with a 1,1-disubstituted hydrazine derivative either in the absence or presence of a solvent. Specific preferred examples of suitable solvents include, but are not limited to, benzene, toluene, xylene, chloronaphthalene, acetic acid, pyridine, methylpyridine, N,N-dimethylformamide, N,N-dimethylacetamide, dimethylethyleneurea, and dimethylsulfoxide. The reaction temperature is preferably from room temperature to 250° C. The reaction may be accelerated when the pH is controlled. The pH can be controlled by using buffer solution prepared by mixing a basic aqueous solution of lithium hydroxide, potassium hydroxide, sodium hydroxide, etc., with an acid such as phosphoric acid.

For example, the naphthalenetetracarboxylic acid diimide derivative having the formula (1) in which a combination of $R^1$ and $R^2$ is different from a combination of $R^3$ and $R^4$ can be manufactured by firstly reacting a naphthalene-1,4,5,8-tetracarboxylic acid dianhydride derivative with a 1,1-disubstituted hydrazine derivative to prepare a monoimide, and secondly reacting the monoimide with another hydrazine derivative having a substituent group different from that in the 1,1-disubstituted hydrazine derivative, as follows:

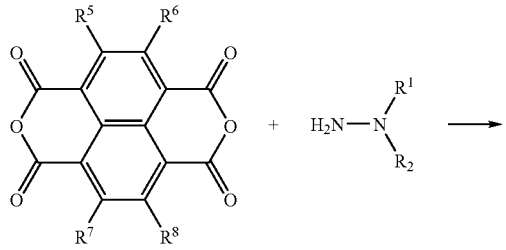

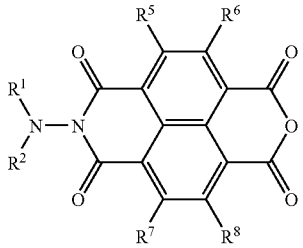

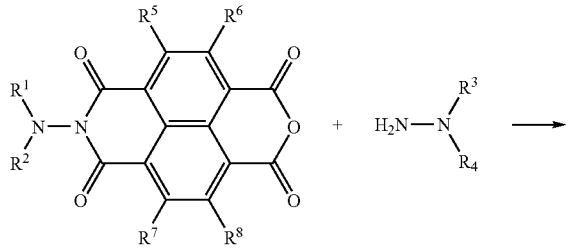

-continued

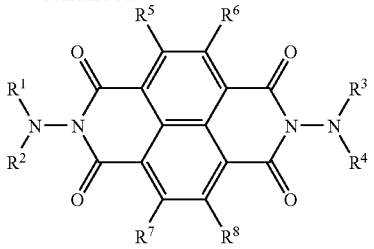

For another example, the naphthalenetetracarboxylic acid diimide derivative having the formula (1) in which a combination of $R^1$ and $R^2$ is the same as a combination of $R^3$ and $R^4$ can be manufactured by reacting 1 mol equivalent of a naphthalenetetracarboxylic acid dianhydride with equal to or greater than 2 mol equivalent of a hydrazine derivative, as follows:

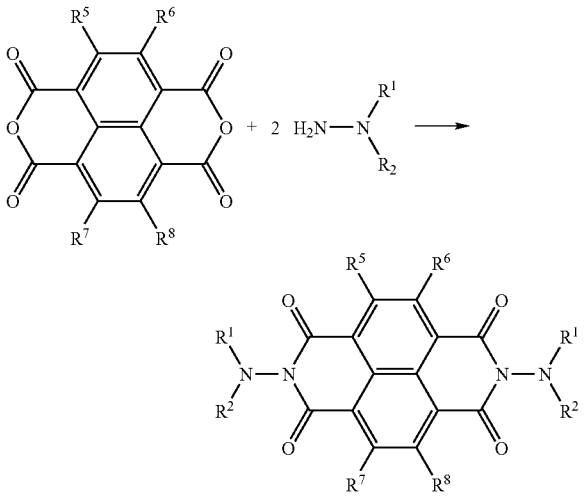

Specific examples of the alkyl group in the formula (1) include, but are not limited to, methyl group, ethyl group, propyl group, butyl group, hexyl group, and undecanyl group. Specific examples of the aromatic hydrocarbon group in the formula (1) include, but are not limited to, groups of aromatic rings such as benzene, biphenyl, naphthalene, anthracene, fluorenone, and pyrene; and groups of aromatic heterocyclic rings such as pyridine, quinoline, thiophene, furan, oxazole, oxadiazole, and carbazole.

The above-described groups may have a substituent group. Specific examples of the substituent groups include, but are not limited to, the above-described alkyl groups; alkoxy groups such as methoxy group, ethoxy group, propoxy group, and butoxy group; halogen atoms such as fluorine, chlorine, bromine, and iodine; dialkylamino groups and diphenylamino groups; the above-described aromatic hydrocarbon groups; and groups of heterocyclic rings such as pyrrolidine, piperidine, and piperazine.

$R^1$ and $R^2$ may optionally share bond connectivity to form a heterocyclic group containing a nitrogen atom. In this case, specific examples of the heterocyclic group include, but are not limited to, condensed heterocyclic groups such as pyrrolidino group, piperidino group, and piperazine group, to which an aromatic hydrocarbon group is condensed.

Specific preferred examples of suitable naphthalenetetracarboxylic acid diimide derivative having the formula (1) are shown in Tables 1-1 to 1-5.

TABLE 1-1

| Compound No. | Structural Formula |
|---|---|
| 1 | 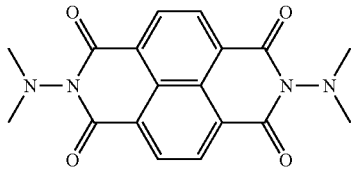 |
| 2 | 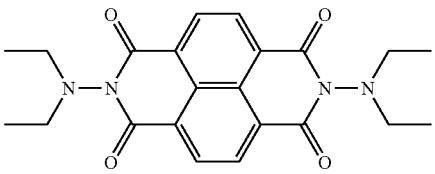 |

TABLE 1-1-continued
| Compound No. | Structural Formula |
|---|---|
| 3 | 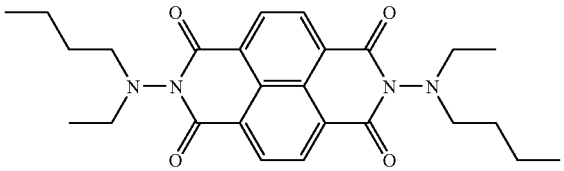 |
| 4 | 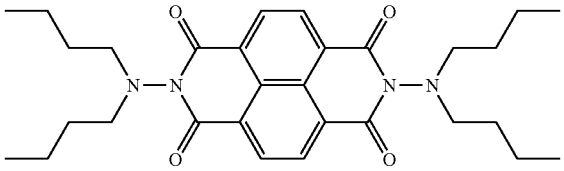 |
| 5 | 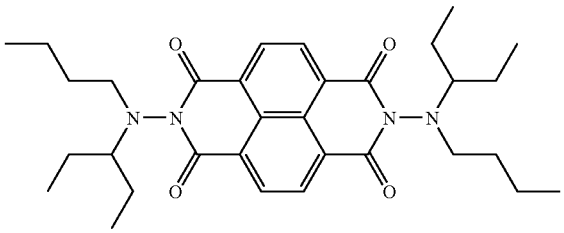 |
| 6 | 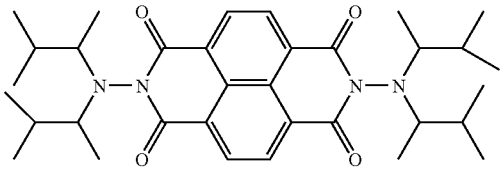 |
| 7 | 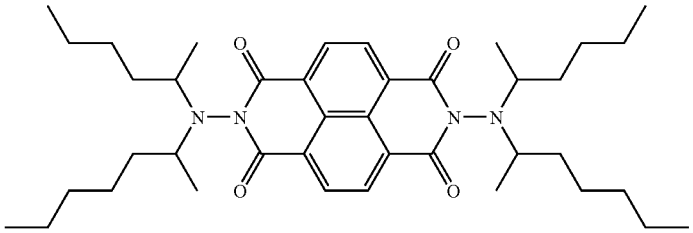 |
| 8 | 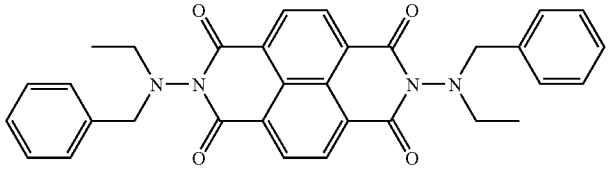 |
| 9 | 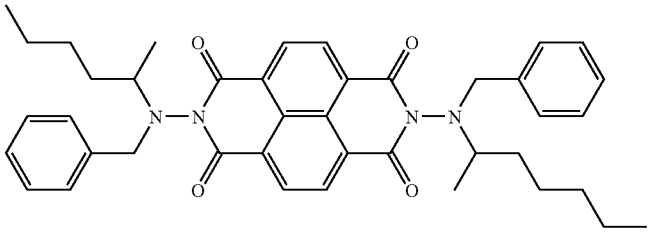 |

TABLE 1-1-continued
| Compound No. | Structural Formula |
|---|---|
| 10 | 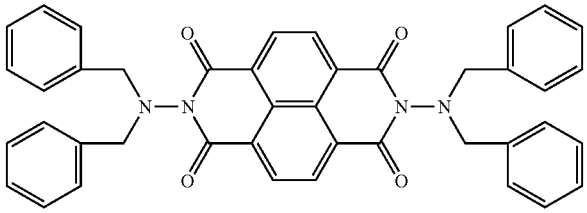 |
TABLE 1-2
| Compound No. | Structural Formula |
|---|---|
| 11 | 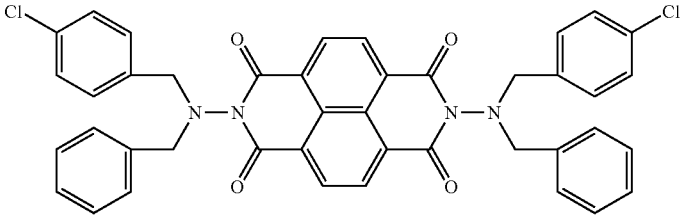 |
| 12 | 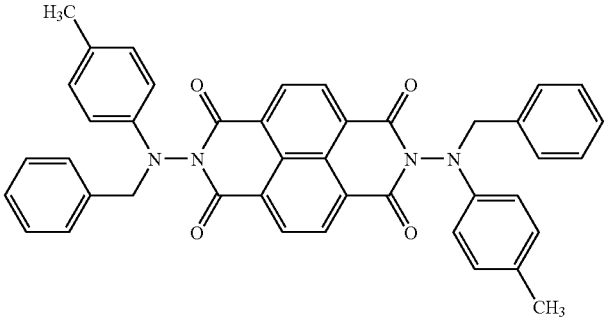 |
| 13 | 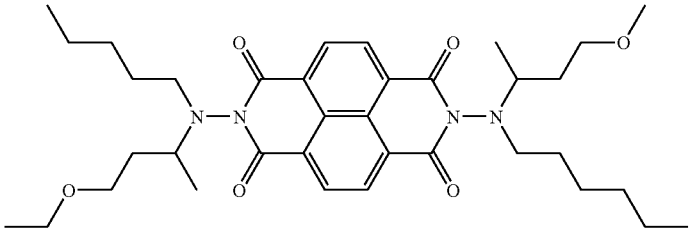 |
| 14 | 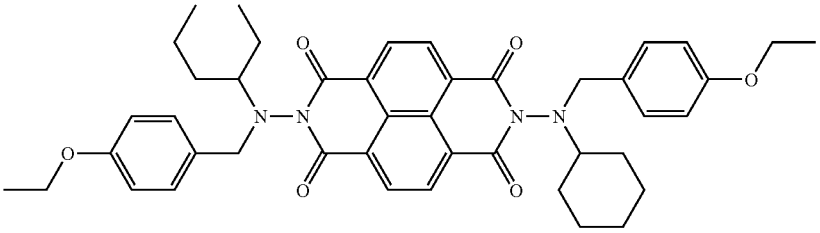 |

TABLE 1-2-continued
| Compound No. | Structural Formula |
|---|---|
| 15 | 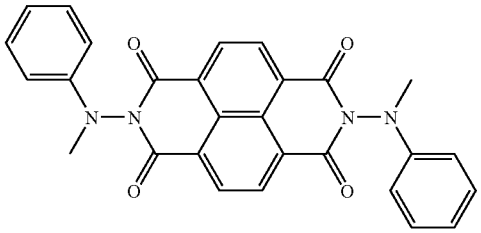 |
| 16 | 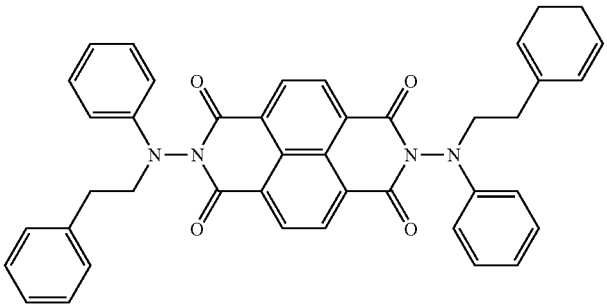 |
| 17 | 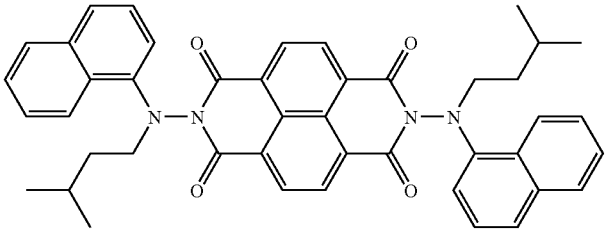 |
| 18 | 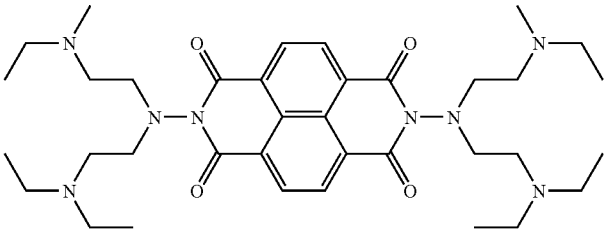 |
TABLE 1-3
| Compound No. | Structural Formula |
|---|---|
| 19 | 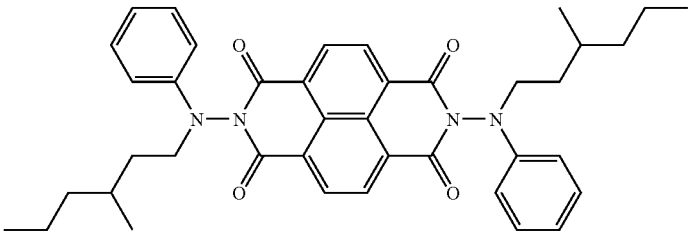 |

TABLE 1-3-continued
| Compound No. | Structural Formula |
|---|---|
| 20 | 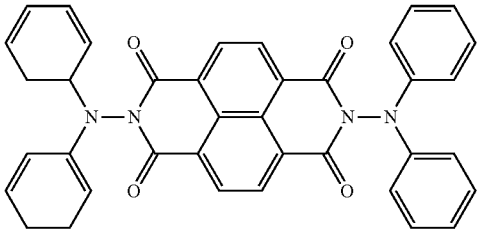 |
| 21 | 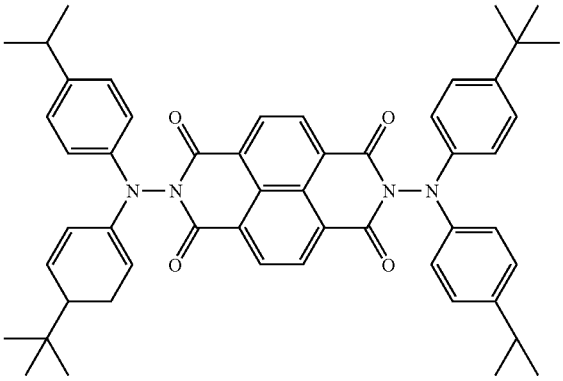 |
| 22 | 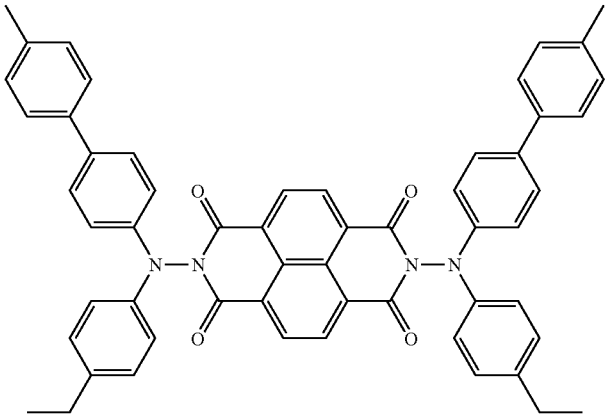 |
| 23 | 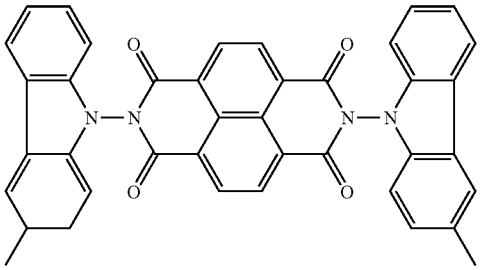 |
| 24 | 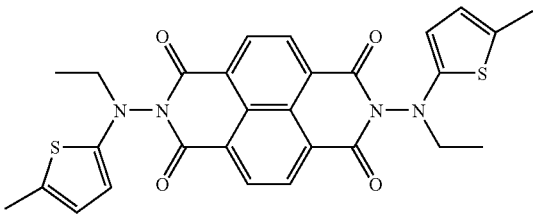 |

TABLE 1-3-continued
| Compound No. | Structural Formula |
|---|---|
| 25 | 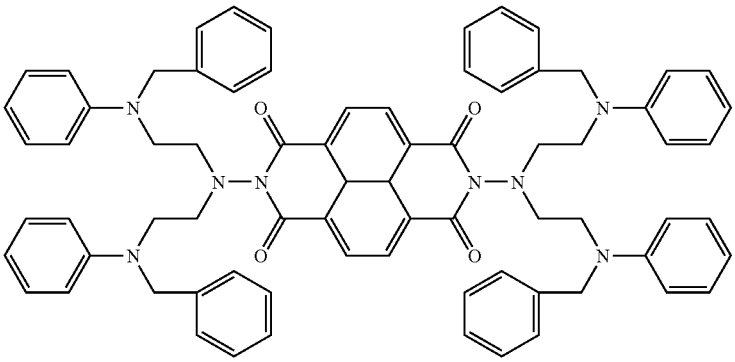 |
| 26 | 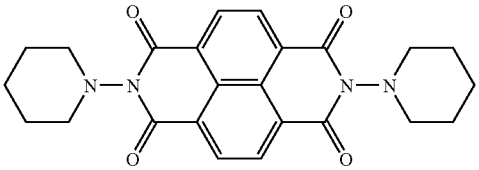 |
TABLE 1-4
| Compound No. | Structural Formula |
|---|---|
| 27 | 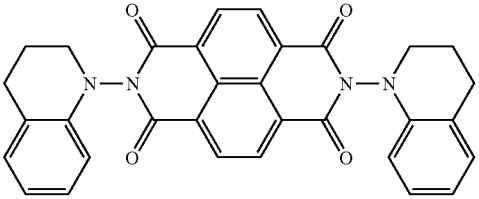 |
| 28 | 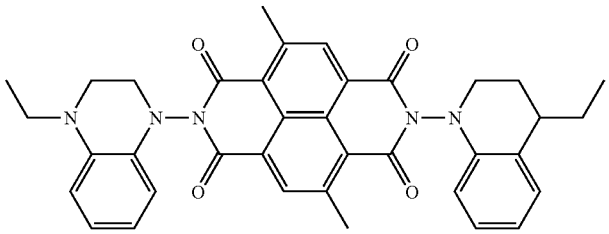 |
| 29 | 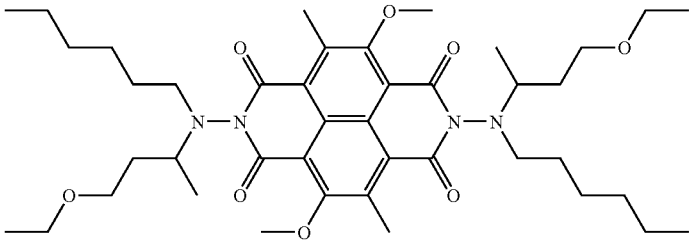 |

TABLE 1-4-continued
| Compound No. | Structural Formula |
|---|---|
| 30 | 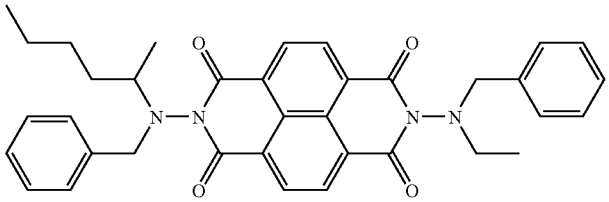 |
| 31 | 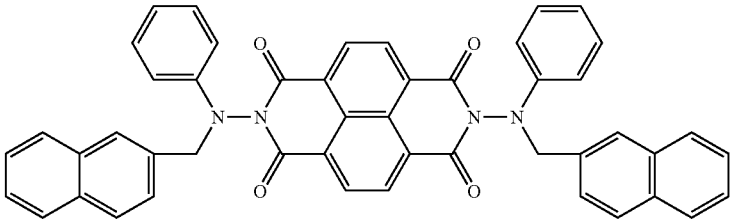 |
| 32 | 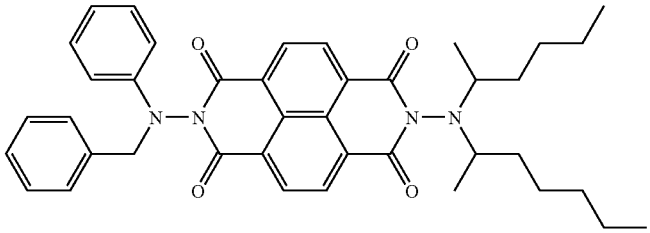 |
| 33 | 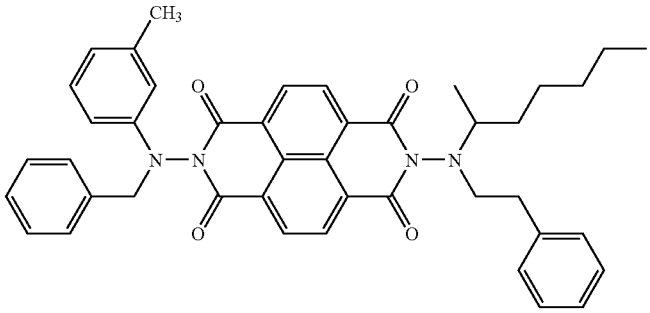 |
| 34 | 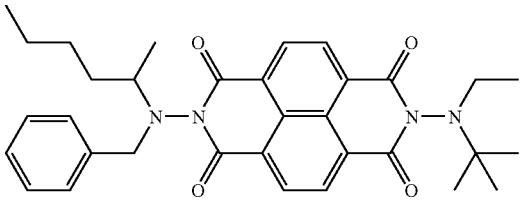 |
| 35 | 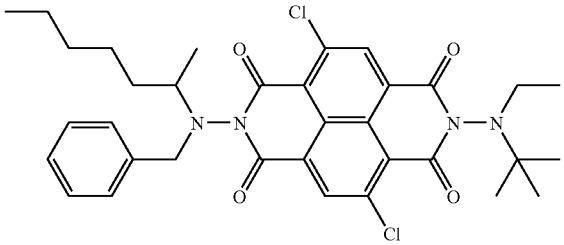 |

TABLE 1-4-continued

| Compound No. | Structural Formula |
|---|---|
| 36 | 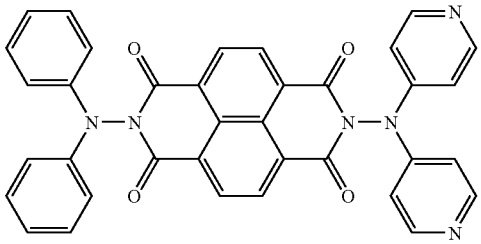 |

TABLE 1-5

| Compound No. | Structural Formula |
|---|---|
| 37 | 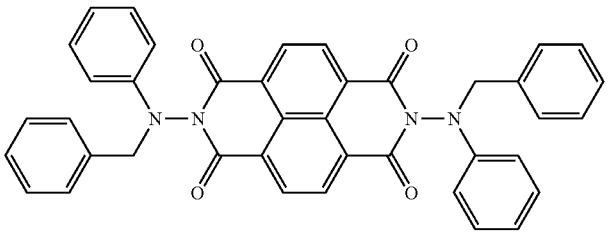 |
| 38 | 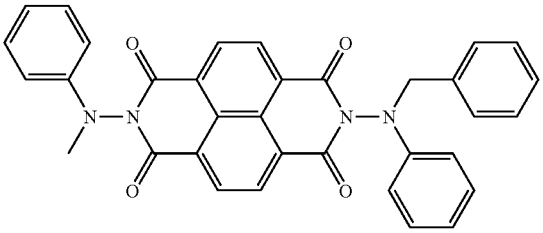 |

Next, the layer structure of the electrophotographic photoreceptor will be explained.

Within the context of the present invention, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

FIG. 1 is a cross-sectional view illustrating an embodiment of the photoreceptor of the present invention, including a conductive substrate 31 and a photosensitive layer 33 including a charge generation material and a charge transport material. The photosensitive layer 33 is overlaid on the conductive substrate 31.

Figure 2:
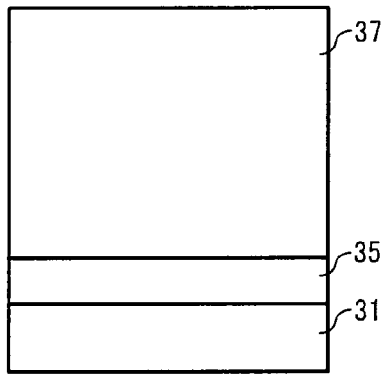

FIG. 2 is a cross-sectional view illustrating another embodiment of the electrophotographic photoreceptor, including a conductive substrate 31, a charge generation layer 35 including a charge generation material, and a charge transport layer 37 including a charge transport material. The charge generation layer 35 and the charge transport layer 37 are overlaid on the conductive substrate 31 in this order.

Figure 3:
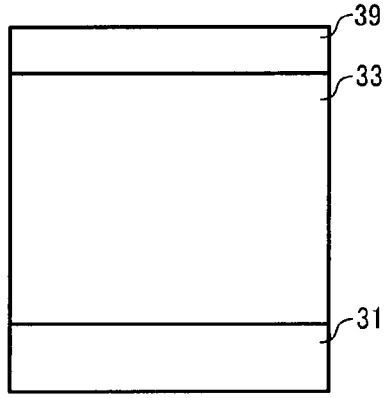

FIG. 3 is a cross-sectional view illustrating yet another embodiment of the electrophotographic photoreceptor, including a conductive substrate 31, a photosensitive layer 33 including a charge generation material and a charge transport material, and a protective layer 39. The photosensitive layer 33 and the protective layer 39 are overlaid on the conductive substrate 31 in this order. The protective layer 39 may optionally include the above-described naphthalenetetracarboxylic acid diimide derivative.

Figure 4:
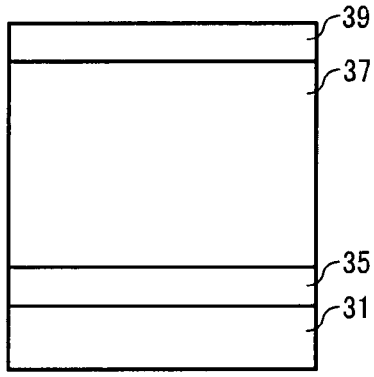

FIG. 4 is a cross-sectional view illustrating yet another embodiment of the electrophotographic photoreceptor, including a conductive substrate 31, a charge generation layer 35 including a charge generation material, a charge transport layer 37 including a charge transport material, and a protective layer 39. The charge generation layer 35, the charge transport layer 37, and the protective layer 39 are overlaid on the conductive substrate 31 in this order. The protective layer 39 may optionally include the above-described naphthalenetetracarboxylic acid diimide derivative.

Figure 5:
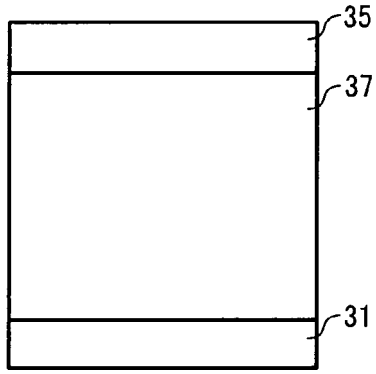

FIG. 5 is a cross-sectional view illustrating yet another embodiment of the electrophotographic photoreceptor, including a conductive substrate 31, a charge transport layer 37 including a charge transport material, and a charge generation layer 35 including a charge generation material. The charge transport layer 37 and the charge generation layer 35 are overlaid on the conductive substrate 31 in this order.

Figure 6:
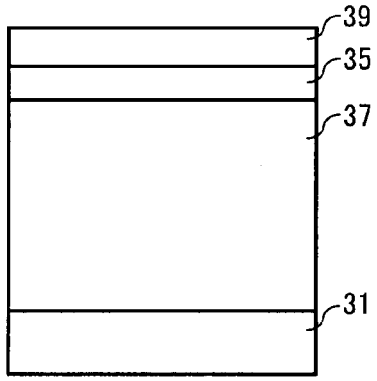

FIG. 6 is a cross-sectional view illustrating another embodiment of the electrophotographic photoreceptor, including a conductive substrate 31, a charge transport layer 37 including a charge transport material, a charge generation layer 35 including a charge generation material, and a protective layer 39. The charge transport layer 37, the charge generation layer 35, and the protective layer 39 are overlaid on the conductive substrate 31 in this order. The protective layer 39 may optionally include the above-described naphthalenetetracarboxylic acid diimide derivative.

Suitable materials for use as the conductive substrate 31 include material having a volume resistivity not greater than $10^{10}$ Ω·cm. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxides, indium oxides, and the like, is formed by deposition or sputtering. In addition, a metal cylinder can also be used as the conductive substrate, which is prepared by tubing a metal such as aluminum, aluminum alloys, nickel, and stainless steel by a method such as a drawing ironing method, an impact ironing method, an extruded ironing method, and an extruded drawing method, and then treating the surface of the tube by cutting, super finishing, polishing, and the like treatments. In addition, and endless nickel belt disclosed in Examined Japanese Application Publication No. (hereinafter JP-B) 52-36016 and an endless stainless belt can be also used as the conductive substrate 31.

Furthermore, substrates, in which a conductive layer is formed on the above-described conductive substrates by applying a coating liquid including a binder resin and a conductive powder thereto, can be used as the conductive substrate 31. Specific examples of such conductive powders include, but are not limited to, carbon black, acetylene black, powders of metals such as aluminum, nickel, iron, nichrome, copper, zinc, and silver, and metal oxides such as conductive tin oxides and ITO. Specific examples of the binder resins include known thermoplastic, thermosetting, and photocrosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylate, phenoxy resins, polycarbonate, cellulose acetate resins, ethylcellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins. Such a conductive layer can be formed by coating a coating liquid in which a conductive powder and a binder resin are dispersed or dissolved in a proper solvent such as tetrahydrofuran, dichloromethane, methyl ethyl ketone, toluene, and the like solvent, and then drying the coated liquid.

In addition, substrates, in which a conductive layer is formed on a surface of a cylindrical substrate using a heat-shrinkable tube which is made of a combination of a resin such as polyvinyl chloride, polypropylene, polyester, polystyrene, polyvinylidene chloride, polyethylene, chlorinated rubber, and TEFLON®, with a conductive powder, can also be used as the conductive substrate 31.

Next, a multilayer photosensitive layer, including the charge generation layer 35 and the charge transport layer 37 that are overlaid on each other will be explained.

The charge generation layer 35 includes a charge generation material as a main component. Any known charge generation materials can be used for the present invention. Specific examples of usable charge generation material include, but are not limited to, azo pigments such as C.I. Pigment Blue 25 (Color Index 21180), C.I. Pigment Red 41 (Color Index 21200), C.I. Acid Red 52 (Color Index 45100), C.I. Basic Red (Color Index 45210), azo pigments having a carbazole skeleton (disclosed in JP-A 53-95033), azo pigments having a distyrylbenzene skeleton (disclosed in JP-A 53-133445), azo pigments having a triphenylamine skeleton (disclosed in JP-A 53-132347), azo pigments having a dibenzothiophene skeleton (disclosed in JP-A 54-21728), azo pigments having an oxadiazole skeleton (disclosed in JP-A 54-12742), azo pigments having a fluorenone skeleton (disclosed in JP-A 54-22834), azo pigments having a bisstilbene skeleton (disclosed in JP-A 54-17733), azo pigments having a distyryl oxadiazole skeleton (disclosed in JP-A 54-2129), azo pigments having a distyryl carbazole skeleton (disclosed in JP-A 54-14967), and azo pigments having a benzanthrone skeleton; phthalocyanine pigments such as C.I. Pigment Blue 16 (Color Index 74100), a Y-type oxotitanium phthalocyanine (disclosed in JP-A 64-17066), an A(β)-type oxotitanium phthalocyanine, a B(α)-type oxotitanium phthalocyanine, a I-type oxotitanium phthalocyanine (disclosed in JP-A 11-21466), a II-type chlorogallium phthalocyanine (disclosed by Iijima et al. in a presentation entitled "(1B4 04) New Polymorphs of Chlorogallium Phthalocyanine and Their Photogenerating Properties" at the 67$^{th}$ annual meeting of the Chemical Society of Japan in 1994), a V-type hydroxygallium phthalocyanine (disclosed by Daimon et al. in a presentation entitled "(1B4 05) A New Polymorph of Hydroxy Gallium phthalocyanine and Its application for Photoreceptor" at the 67$^{th}$ annual meeting of the Chemical Society of Japan in 1994), and a X-type metal-free phthalocyanine (disclosed in U.S. Pat. No. 3,816,118); indigo dyes such as C.I. Vat Brown 5 (Color Index 73410) and C.I. Vat Dye (Color Index 73030); and perylene pigments such as ALGOL SCARLET B and an INDANTHRENE SCARLET R (both from Bayer AG). These materials can be used alone or in combination.

The charge generation layer 35 can be prepared as follows, for example. At first, a charge generation material is dispersed in a solvent optionally together with a binder resin using a typical dispersion means such as a ball mill, an attritor, a sand mill, or an ultrasonic disperser, to prepare a charge generation layer coating liquid. The charge generation layer coating liquid thus prepared is coated on a conductive substrate, followed by drying.

Specific examples of the binder resin optionally used for the charge generation layer 35 include, but are not limited to, polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyvinyl pyridine, cellulose resins, casein, polyvinyl alcohol, and polyvinyl pyrrolidone. The content of the binder resin in the charge generation layer 35 is preferably from 0 to 500 parts by weight, and more preferably from 10 to 300 parts by weight, per 100 parts by weight of the charge generation material included in the charge generation layer 35. The binder resin may be added to the coating liquid either before or after the charge generation material is dispersed therein.

Specific examples of the solvents for use in the dispersion of the charge generation material include, but are not limited to, organic solvents such as isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Among these solvents, ketone solvents, ester solvents, and ether solvents are preferably used. These solvents can be used alone or in combination.

The charge generation layer coating liquid includes the charge generation material, the solvent, and the binder resin as main components, and optionally includes additives such as an intensifier, a dispersing agent, a surfactant, and a silicone oil.

Suitable coating methods include, but are not limited to, a dip coating method, a spray coating method, a bead coating method, a nozzle coating method, a spinner coating method, and a ring coating method.

The charge generation layer 35 preferably has a thickness of from 0.01 to 5 μm, and more preferably from 0.1 to 2 μm.

The charge transport layer 37 includes a charge transport material as a main component. Charge transport materials will be explained by classifying into hole transport materials, electron transport materials, and charge transport polymers.

Specific preferred examples of suitable hole transport materials include, but are not limited to, poly-N-carbazole and derivatives thereof, poly-γ-carbazolylethyl glutamate and derivatives thereof, pyrene-formaldehyde condensates and derivatives thereof, polyvinyl pyrene, polyvinyl phenanthrene, oxazole derivatives, imidazole derivatives, triphenylamine derivatives, and compounds having the following formulae (11) to (16), (19) to (22), (26) to (32) and (34) to (38).

(11)

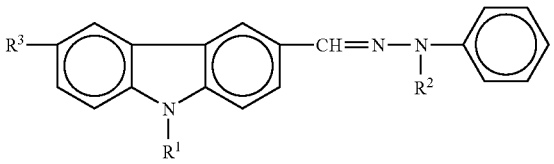

wherein $R^1$ represents a methyl group, an ethyl group, a 2-hydroxyethyl group, or a 2-chloroethyl group; $R^2$ represents a methyl group, an ethyl group, a benzyl group, or a phenyl group; $R^3$ represents a hydrogen atom, a chlorine atom, a bromine atom, an alkyl group having 1 to 4 carbon atoms, an alkoxy group having 1 to 4 carbon atoms, a dialkylamino group, or a nitro group.

Specific examples of the compound having the formula (11) include, but are not limited to, 9-ethylcarbazole-3-carbaldehyde 1-methyl-1-phenylhydrazone, 9-ethylcarbazole-3-carbaldehyde 1-benzyl-1-phenylhydrazone, and 9-ethylcarbazole-3-carbaldehyde 1,1-diphenylhydrazone.

(12)

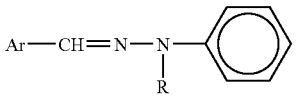

wherein Ar represents a naphthalene ring or a substitution thereof, an anthracene ring or a substitution thereof, a pyrene ring or a substitution thereof, a pyridine ring, a furan ring, or a thiophene ring; and R represents an alkyl group, a phenyl group, or a benzyl group.

Specific examples of the compound having the formula (12) include, but are not limited to, 4-diethylaminostyryl-β-carbaldehyde 1-methyl-1-phenylhydrazone and 4-methoxynaphthalene-1-carbaldehyde 1-benzyl-1-phenylhydrazone.

(13)

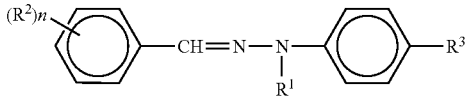

wherein $R^1$ represents an alkyl group, a benzyl group, a phenyl group, or a naphthyl group; $R^2$ represents a hydrogen atom, an alkyl group having 1 to 3 carbon atoms, an alkoxy group having 1 to 3 carbon atoms, a dialkylamino group, a diaralkyl amino group, or a diarylamino group; n represents an integer of from 1 to 4; when n is 2 or more, multiple $R^2$ may be, but need not necessarily be, the same; and $R^3$ represents a hydrogen atom or a methoxy group.

Specific examples of the compound having the formula (13) include, but are not limited to, 4-methoxybenzaldehyde 1-methyl-1-phenylhydrazone, 2,4-dimethoxybenzaldehyde 1-benzyl-1-phenylhydrazone, 4-diethylaminobenzaldehyde 1,1-diphenylhydrazone, 4-methoxybenzaldehyde 1-(4-methoxy)phenylhydrazone, 4-diphenylaminobenzaldehyde 1-benzyl-1-phenylhydrazone, and 4-dibenzylaminobenzaldehyde 1,1-diphenylhydrazone.

(14)

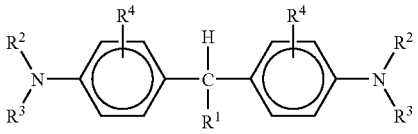

wherein $R^1$ represents an alkyl group having 1 to 11 carbon atoms, a substituted or unsubstituted phenyl group, or a heterocyclic group; each of $R^2$ and $R^3$ independently represents a hydrogen atom, an alkyl group having 1 to 4 carbon atoms, a hydroxyalkyl group, a chloroalkyl group, or a substituted or unsubstituted aralkyl group; $R^2$ and $R^3$ may optionally share bond connectivity to form a heterocyclic ring containing a nitrogen atom; each of multiple $R^4$ independently represents a hydrogen atom, an alkyl group having 1 to 4 carbon atoms, an alkoxy group, or a halogen atom.

Specific examples of the compound having the formula (14) include, but are not limited to, 1,1-bis(4-dibenzylaminophenyl)propane, tris(4-diethylaminophenyl)methane, and 2,2'-dimethyl-4,4'-bis(diethylamino)-triphenylmethane.

(15)

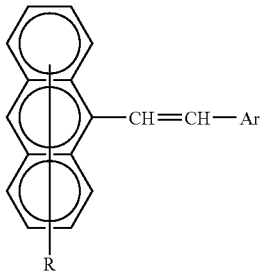

wherein R represents a hydrogen atom or a halogen atom; and Ar represents a substituted or unsubstituted phenyl, naphthyl, anthryl, or carbazolyl group.

Specific examples of the compound having the formula (15) include, but are not limited to, 9-(4-diethylaminostyryl)anthracene and 9-bromo-10-(4-diethylaminostyryl)anthracene.

(16)

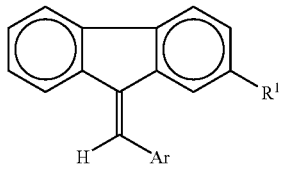

wherein $R^1$ represents a hydrogen atom, a halogen atom, a cyano group, an alkoxy group having 1 to 4 carbon atoms, or an alkyl group having 1 to 4 carbon atoms; and Ar represents a group having the following formulae (17) or (18):

(17)

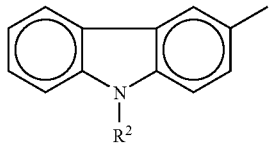

(18)

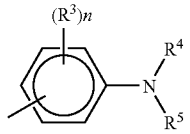

wherein $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms, or a dialkylamino group; n represents an integer of 1 or 2; when n is 2, multiple $R^3$ may be, but need not necessarily be, the same; and each of $R^4$ and $R^5$ independently represents a hydrogen atom, a substituted or unsubstituted alkyl group having 1 to 4 carbon atoms, or a substituted or unsubstituted benzyl group.

Specific examples of the compound having the formula (16) include, but are not limited to, 9-(4-dimethylaminobenzylidene)fluorenone and 3-(9-fluorenylidene)-9-ethylcarbazole.

(19)

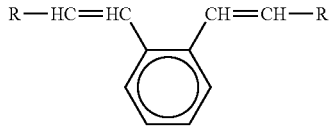

wherein R represents a carbazolyl group, a pyridyl group, a thienyl group, an indolyl group, a furyl group, a substituted or unsubstituted phenyl group, a substituted or unsubstituted styryl group, a substituted or unsubstituted naphthyl group, or a substituted or unsubstituted anthryl group; and substituent groups thereof are selected from the group consisting of a dialkylamino group, an alkyl group, an alkoxy group, a carboxyl group and an ester thereof, a halogen atom, a cyano group, an aralkylamino group, an N-alkyl-N-aralkylamino group, an amino group, a nitro group, and an acetylamino group.

Specific examples of the compound having the formula (19) include, but are not limited to, 1,2-bis(4-diethylaminostyryl)benzene and 1,2-bis(2,4-dimethoxystyryl)benzene.

(20)

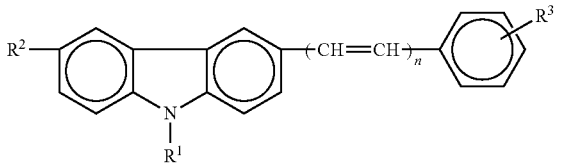

wherein $R^1$ represents a lower alkyl group, a substituted or unsubstituted phenyl group, or a benzyl group; each of $R^2$ and $R^3$ independently represents a hydrogen atom, a lower alkyl group, a lower alkoxy group, a halogen atom, a nitro group, an amino group, or an amino group substituted with a lower alkyl group or a benzyl group; and n represents an integer of 1 or 2.

Specific examples of the compound having the formula (20) include, but are not limited to, 3-styryl-9-ethylcarbazole and 3-(4-mehoxystyryl)-9-ethylcarbazole.

(21)

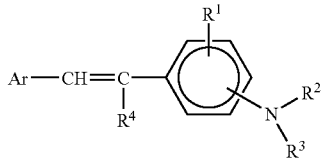

wherein $R^1$ represents a hydrogen atom, an alkyl group, an alkoxy group, or a halogen atom; each of $R^2$ and $R^3$ independently represents a substituted or unsubstituted aryl group; $R^4$ represents a hydrogen atom, a lower alkyl group, or a substituted or unsubstituted phenyl group; and Ar represents a substituted or unsubstituted phenyl or naphthyl group.

Specific examples of the compound having the formula (21) include, but are not limited to, 4-diphenylaminostilbene, 4-dibenzylaminostilbene, 4-ditolylaminostilbene, and 1-(4-diphenylaminostyryl)naphthalene.

(22)

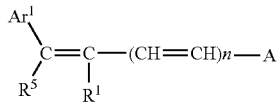

wherein n represents an integer of 0 or 1; $R^1$ represents a hydrogen atom, an alkyl group, or a substituted or unsubstituted phenyl group; $Ar^1$ represents a substituted or unsubstituted aryl group; $R^5$ represents a substituted or unsubstituted alkyl group or a substituted or unsubstituted aryl group; A represents a group having the following formulae (23) or (24), a 9-anthryl group, or a substituted or unsubstituted carbazolyl group; and when n is 0, A and R1 may optionally share bond connectivity to form a ring:

(23)

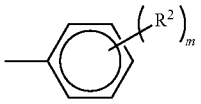

(24)

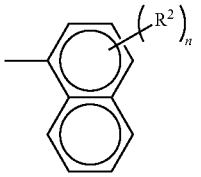

wherein $R^2$ represents a hydrogen atom, an alkyl group, an alkoxy group, a halogen atom, or a group having the following formula (25); m represents an integer of from 1 to 5; n represents an integer of from 1 to 7; and when each of m and n is 2 or more, multiple $R^2$ may be, but need not necessarily be, the same:

(25)

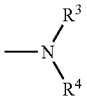

wherein each of $R^3$ and $R^4$ independently represents a substituted or unsubstituted aryl group, and $R^3$ and $R^4$ may optionally share bond connectivity to form a ring.

Specific examples of the compound having the formula (22) include, but are not limited to, 4'-diphenylamino-α-phenylstilbene and 4'-bis(4-methylphenyl)amino-α-phenylstilbene.

(26)

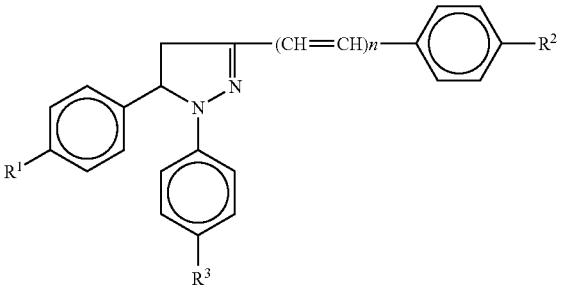

wherein each of $R^1$, $R^2$, and $R^3$ independently represents a hydrogen atom, a lower alkyl group, a lower alkoxy group, a halogen atom, or a dialkylamino group; and n represents an integer of 0 or 1.

Specific examples of the compound having the formula (26) include, but are not limited to, 1-phenyl-3-(4-diethylaminostyryl)-5-(4-diethylaminophenyl)pyrazoline.

(27)

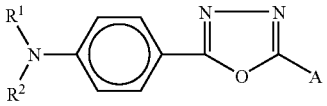

wherein each of $R^1$ and $R^2$ independently represents a substituted or unsubstituted alkyl group or a substituted or unsubstituted aryl group; and A represents a substituted amino group, a substituted or unsubstituted aryl group, or a substituted or unsubstituted allyl group.

Specific examples of the compound having the formula (27) include, but are not limited to, 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

(28)

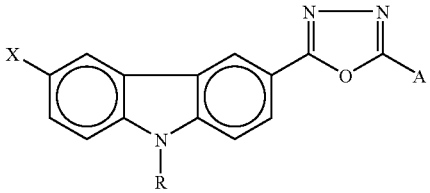

wherein X represents a hydrogen atom, a lower alkyl group, or a halogen atom; R represents a substituted or unsubstituted alkyl group or a substituted or unsubstituted aryl group; and A represents an amino group or a substituted or unsubstituted aryl group.

Specific examples of the compound having the formula (28) include, but are not limited to, 2,-N,N-diphenylamino-5-(N-ethylcarbazole-3-yl)-1,3,4-oxadiazole and 2-(4-diethylaminophenyl)-5-(N-ethylcarbazole-3-yl)-1,3,4-oxadiazole.

(29)

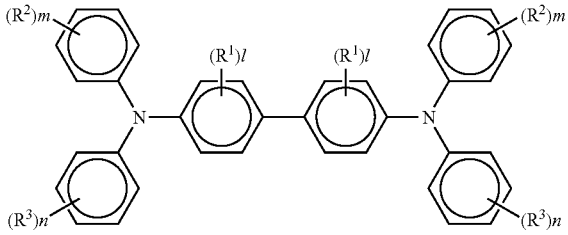

wherein $R^1$ represents a lower alkyl group, a lower alkoxy group, or a halogen atom; each of $R^2$ and $R^3$ independently represents a hydrogen atom, a lower alkyl group, a lower alkoxy group, or a halogen atom; and each of l, m, and n independently represents an integer of from 0 to 4.

Specific examples of the benzidine compound having the formula (29) include, but are not limited to, N,N'-diphenyl-N,N'-bis(3-methylphenyl)-[1,1'-biphenyl]-4,4'-diamine and 3,3'-dimethyl-N,N,N',N'-tetrakis(4-methylphenyl)-[1,1'-biphenyl]-4,4'-diamine.

(30)

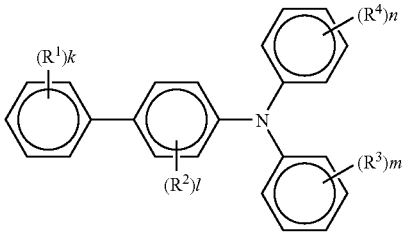

wherein each of $R^1$, $R^3$, and $R^4$ independently represents a hydrogen atom, an amino group, an alkoxy group, a thioalkoxy group, an aryloxy group, a methylenedioxy group, a substituted or unsubstituted alkyl group, a halogen group, or a substituted or unsubstituted aryl group; $R^2$ represents a hydrogen atom, an alkoxy group, a substituted or unsubstituted alkyl group, or a halogen atom; a case in which $R^1$, $R^2$, $R^3$, and $R^4$ are all hydrogen atoms is excluded; each of k, l, m, and n independently represents an integer of from 1 to 4; and when k, l, m, and n each are 2 or more, multiple $R^1$, $R^2$, $R^3$, and $R^4$ each may be, but need not necessarily be, the same.

Specific examples of the biphenylylamine compound having the formula (30) include, but are not limited to, 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and N,N-bis(3,4-dimethylphenyl)-[1,1'-biphenyl]-4-amine.

(32)

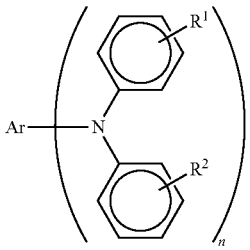

wherein Ar represents a condensed polycyclic hydrocarbon group having 18 or less carbon atoms which may have a substituent group; each of $R^1$ and $R^2$ independently represents a hydrogen atom, a halogen atom, a substituted or unsubstituted alkyl group, an alkoxy group, or a substituted or unsubstituted phenyl group; and n represents an integer of from 1 or 2.

Specific examples of the triarylamine compound having the formula (31) include, but are not limited to, N,N-diphenyl-pyrene-1-amine, N,N-di-p-tolyl-pyrene-1-amine, N,N-di-p-tolyl-1-naphthylamine, N,N-di(p-tolyl)-1-phenanthrylamine, 9,9-dimethyl-2-(di-p-tolylamino)fluorene, N,N,N',N'-tetrakis(4-methylphenyl)-phenanthrene-9,10-diamine, and N,N,N',N'-tetrakis(3-methylphenyl)-m-phenylenediamine.

A-CH═CH—Ar—CH═CH-A (32)

wherein Ar represents a substituted or unsubstituted aromatic hydrocarbon group; and A represents a group having the following formula (33):

(33)

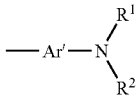

wherein Ar' represents a substituted or unsubstituted aromatic hydrocarbon group; and each of $R^1$ and $R^2$ independently represents a substituted or unsubstituted alkyl group or a substituted or unsubstituted aryl group.

Specific examples of the diolefin aromatic compound having the formula (33) include, but are not limited to, 1,4-bis(4-diphenylaminostyryl)benzene and 1,4-bis[4-di(p-tolyl)aminostyryl]benzene.

(34)

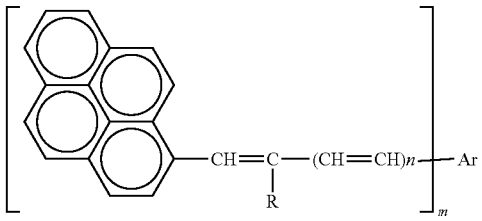

wherein Ar represents a substituted or unsubstituted aromatic hydrocarbon group; R represents a hydrogen atom, a substituted or unsubstituted alkyl group, or a substituted or unsubstituted aryl group; n represents an integer of 0 or 1 and m represents an integer of 1 or 2; and when n is 0 and m is 1, Ar and R may optionally share bond connectivity to form a ring.

Specific examples of the styrylpyrene compound having the formula (34) include, but are not limited to, 1-(4-diphenylaminostyryl)pyrene and 1-(N,N-di-p-tolyl-4-aminostyryl)pyrene.

Specific preferred examples of suitable electron transport materials include, but are not limited to, chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and compounds having the following formulae (35) to (38):

(35)

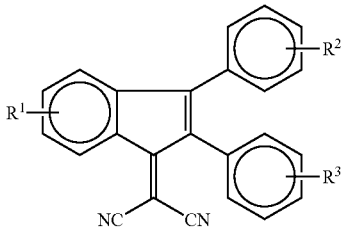

wherein each of $R^1$, $R^2$, and $R^3$ independently represents a hydrogen atom, a halogen atom, a substituted or unsubstituted alkyl group, an alkoxy group, or a substituted or unsubstituted phenyl group;

(36)

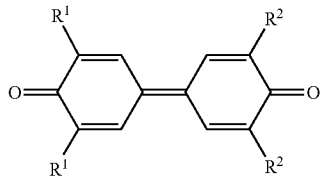

wherein each of $R^1$ and $R^2$ independently represents a hydrogen atom, a substituted or unsubstituted alkyl group, or a substituted or unsubstituted phenyl group;

(37)

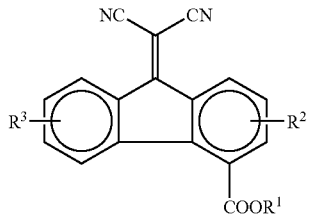

wherein each of $R^1$, $R^2$, and $R^3$ independently represents a hydrogen atom, a halogen atom, a substituted or unsubstituted alkyl group, an alkoxy group, or a substituted or unsubstituted phenyl group;

(38)

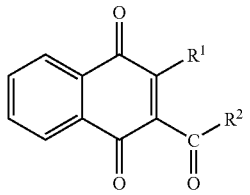

wherein $R^1$ represents an alkyl group which may have a substituent group or an aryl group which may have a substituent group; $R^2$ represents an alkyl group which may have a substituent group, an aryl group which may have a substituent group, or a group having the following formula (39):

$$—O—R^3 \quad (39)$$

wherein $R^3$ represents an alkyl group which may have a substituent group or an aryl group which may have a substituent group.

Specific examples of binder resins for use in the charge transport layer 37 include, but are not limited to, thermoplastic and thermosetting resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate resins, phenoxy resins, polycarbonate, cellulose acetate resins, ethylcellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins.

A total amount of the charge transport material and the naphthalenetetracarboxylic acid diimide derivative included in the charge transport layer 37 is preferably from 20 to 300 parts by weight, and more preferably from 40 to 150 parts by weight, per 100 parts by weight of the binder resin. The charge transport layer 37 preferably has a thickness of not greater than 25 μm, from the viewpoint of improving image resolution and responsiveness, and not less than 5 μm. However, the lower limit depends on the system, in particular the charging potential thereof, for which the photoreceptor is used.

Further, the amount of the naphthalenetetracarboxylic acid diimide derivative is preferably from 0.01 to 150% by weight based on the charge transport material. When the amount of the naphthalenetetracarboxylic acid diimide derivative is too small, the resultant photoreceptor has poor resistance to oxidizing gases. When the amount of the naphthalenetetracarboxylic acid diimide derivative is too large, residual potential greatly increases by repeated use.

Specific preferred examples of suitable solvents used for the charge transport layer 37 include, but are not limited to, tetrahydrofuran, dioxane, toluene, dichloromethane, monochlorobenzene, dichloroethane, cyclohexanone, methyl ethyl ketone, and acetone. The charge transport materials can be used alone or in combination.

Specific preferred examples of suitable antioxidants for preventing deterioration of the naphthalenetetracarboxylic acid diimide derivative include (c) hydroquinone compounds and (f) hindered amine compounds, to be explained in detail later. The antioxidant is preferably added to a coating liquid before the naphthalenetetracarboxylic acid diimide derivative is added thereto. The added amount of the antioxidant is preferably from 0.1 to 200% by weight based on the naphthalenetetracarboxylic acid diimide derivative.

Charge transport polymers, which have functions of both a binder resin and a charge transport material, can be preferably used for the charge transport layer 37 because the resultant charge transport layer has good abrasion resistance. Any known charge transport polymers can be used. Particularly, polycarbonates having a triarylamine structure in a main chain and/or side chain thereof are preferably used. Among these, charge transport polymers having the following formulae (I) and (IV) to (XIII) are preferably used:

(I)

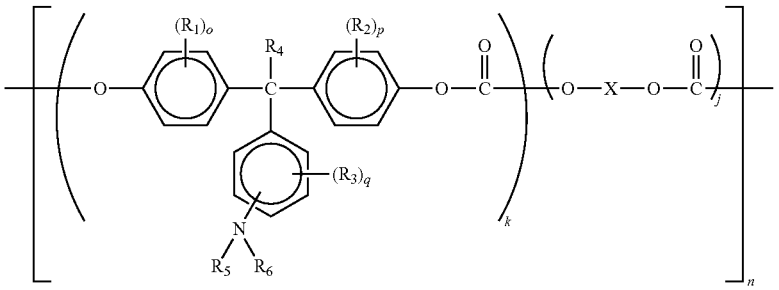

wherein each of $R_1$, $R_2$, and $R_3$ independently represents a substituted or unsubstituted alkyl group or a halogen atom; $R_4$ represents a hydrogen atom or a substituted or unsubstituted alkyl group; each of $R_5$ and $R_6$ independently represents a substituted or unsubstituted aryl group; each of o, p, and q independently represents an integer of from 0 to 4; k represents a number of from 0.1 to 1 and j represents a number of from 0 to 0.9; n represents an integer of from 5 to 5000; and x represents a divalent aliphatic group, a divalent alicyclic group, or a divalent group having the following formula (II):

(II)

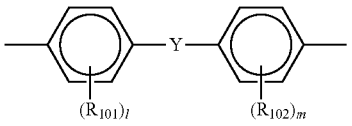

wherein each of $R_{101}$ and $R_{102}$ independently represents a substituted or unsubstituted alkyl group, a substituted or unsubstituted aryl group, or a halogen atom; each of l and m independently represents an integer of from 0 to 4; and Y represents a single bond, a linear, branched, or cyclic alkylene group having 1 to 12 carbon atoms, —O—, —S—, —SO—, —$SO_2$—, —CO—, —CO—O—Z—O—CO— (Z represents a divalent aliphatic group), or a group having the following formula (III):

(III)

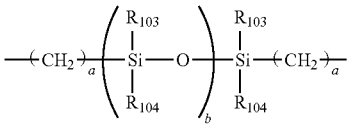

wherein a represents an integer of from 1 to 20; b represents an integer of from 1 to 2000; and each of $R_{103}$ and $R_{104}$ independently represents a substituted or unsubstituted alkyl group or a substituted or unsubstituted aryl group, wherein $R_{101}$, $R_{102}$, $R_{103}$, and $R_{104}$ may be the same or different from the others;

(IV)

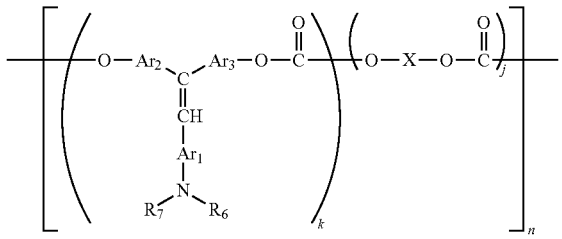

wherein each of $R_7$ and $R_8$ independently represents a substituted or unsubstituted aryl group; each of $Ar_1$, $Ar_2$, and $Ar_3$ independently represents an arylene group; and X, k, j, and n are as defined in the formula (I);

(V)

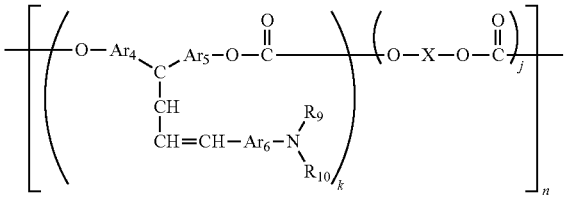

wherein each of $R_9$ and $R_{10}$ independently represents a substituted or unsubstituted aryl group; each of $Ar_4$, $Ar_5$, and $Ar_6$ independently represents an arylene group; and X, k, j, and n are as defined in the formula (I);

(VI)

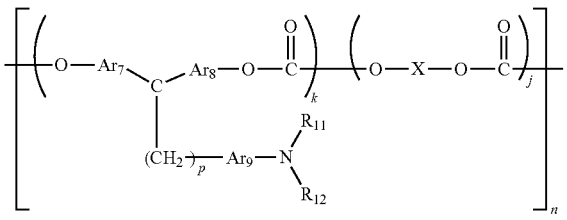

wherein each of $R_{11}$ and $R_{12}$ independently represents a substituted or unsubstituted aryl group; each of $Ar_7$, $Ar_8$, and $Ar_9$ independently represents an arylene group; p represents an integer of from 1 to 5; and X, k, j, and n are as defined in the formula (I);

(VII)

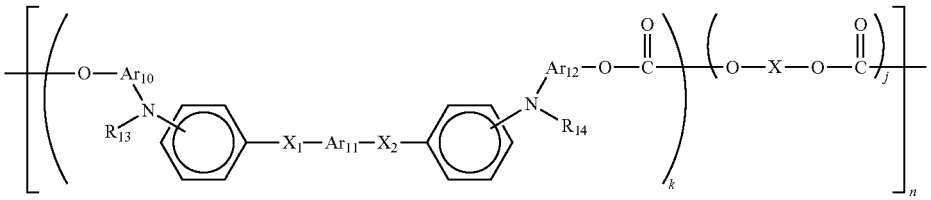

wherein each of $R_{13}$ and $R_{14}$ independently represents a substituted or unsubstituted aryl group; each of $Ar_{10}$, $Ar_{11}$, and $Ar_{12}$ independently represents an arylene group; each of $X_1$ and $X_2$ independently represents a substituted or unsubstituted ethylene group or a substituted or unsubstituted vinylene group; and X, k, j, and n are as defined in the formula (I);

(VIII)

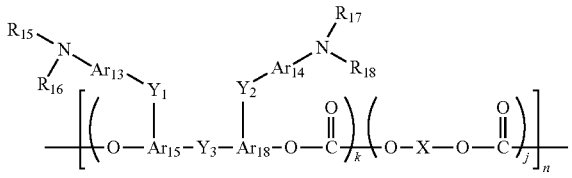

wherein each of $R_{15}$, $R_{16}$, $R_{17}$, and $R_{18}$ independently represents a substituted or unsubstituted aryl group; each of $Ar_{13}$, $Ar_{14}$, $Ar_{15}$, and $Ar_{16}$ independently represents an arylene group; each of $Y_1$, $Y_2$, and $Y_3$ independently represents a single bond, a substituted or unsubstituted alkylene group, a substituted or unsubstituted cycloalkylene group, a substituted or unsubstituted alkylene ether group, an oxygen atom, a sulfur atom, or a vinylene group; and X, k, j, and n are as defined in the formula (I);

(IX)

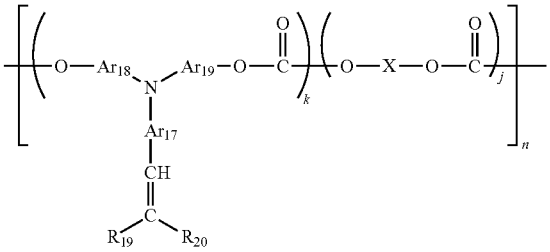

wherein each of $R_{19}$ and $R_{20}$ independently represents a hydrogen atom or a substituted or unsubstituted aryl group; $R_{19}$ and $R_{20}$ may optionally share bond connectivity to form a ring; each of $Ar_{17}$, $Ar_{18}$, and $Ar_{19}$ independently represents an arylene group; and X, k, j, and n are as defined in the formula (I);

(X)

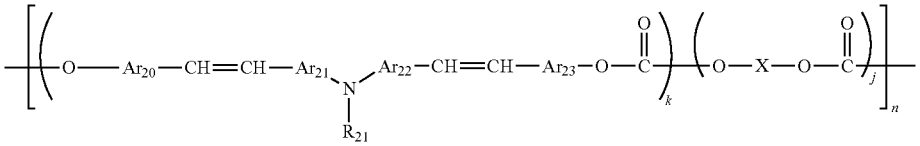

wherein $R_{21}$ represents a substituted or unsubstituted aryl group; each of $Ar_{20}$, $Ar_{21}$, $Ar_{22}$, and $Ar_{23}$ independently represents an arylene group; and X, k, j, and n are as defined in the formula (I);

(XI)

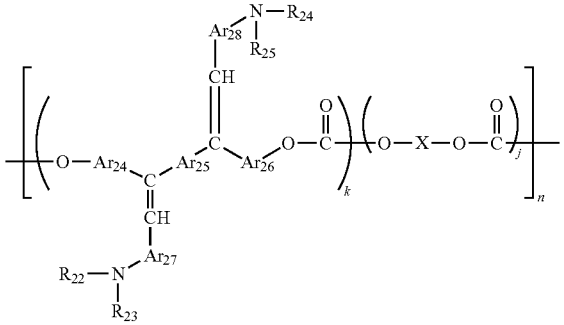

wherein each of $R_{22}$, $R_{23}$, $R_{24}$, and $R_{25}$ independently represents a substituted or unsubstituted aryl group; each of $Ar_{24}$, $Ar_{25}$, $Ar_{26}$, $Ar_{27}$, and $Ar_{28}$ independently represents an arylene group; and X, k, j, and n are as defined in the formula (I);

(XII)

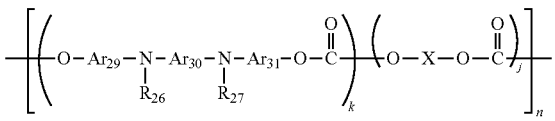

wherein each of $R_{26}$ and $R_{27}$ independently represents a substituted or unsubstituted aryl group; each of $Ar_{29}$, $Ar_{30}$, and $Ar_{31}$ independently represents an arylene group; and X, k, j, and n are as defined in the formula (I); and

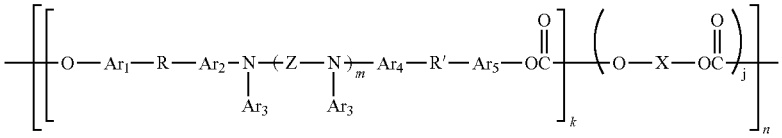

wherein each of $Ar_1$, $Ar_1$, $Ar_3$, $Ar_4$, and $Ar_5$ independently represents a substituted or unsubstituted aromatic ring group; Z represents an aromatic ring group or —$Ar_6$—Za-$Ar_6$—, wherein $Ar_6$ represents a substituted or unsubstituted aromatic ring group and Za represents O, S, or an alkylene group; each of R and R' independently represents a straight-chain or branched-chain alkylene group; m represents an integer of 0 or 1; and X, k, j, and n are as defined in the formula (I).

The charge transport layer 37 can be prepared as follows, for example. At first, a charge transport material is dissolved or dispersed in a solvent optionally together with a binder resin, to prepare a charge transport layer coating liquid. The charge transport layer coating liquid thus prepared is coated on the charge generation layer, followed by drying. The charge transport layer coating liquid may optionally include a plasticizer, a leveling agent, antioxidant, and the like.

Suitable coating methods include, but are not limited to, a dip coating method, a spray coating method, a bead coating method, a nozzle coating method, a spinner coating method, and a ring coating method.

Next, the photosensitive layer 33, which is single-layered, will be explained. The photosensitive layer 33 is typically formed by coating a coating liquid, which is prepared by dispersing or dissolving a charge generation material, a charge transport material, a binder resin in a solvent, on a conductive substrate, followed by drying. Suitable materials for use as the charge generation material and the charge transport material include the materials described above for use as the charge generation material in the charge generation layer and the charge transport material in the charge transport layer, respectively. The coating liquid may optionally include a plasticizer, a leveling agent, an antioxidant, and the like.

Suitable materials for use as the binder resin include the materials described above for use as the binder resin in the charge generation layer 35 and the charge transport layer 37. In addition, the charge transport polymers described above can also be preferably used for the photosensitive layer 33. The content of the charge generation material is preferably from 5 to 40 parts by weight, and the content of the charge transport material is preferably from 0 to 190 parts by weight, and more preferably from 50 to 150 parts by weight, per 100 parts by weight of the binder resin included in the layer.

The photosensitive layer 33 is typically prepared by coating a coating liquid, which is prepared by dissolving or dispersing a charge generation material, a binder resin, and optionally together with a charge transport material in a solvent such as tetrahydrofuran, dioxane, dichloroethane, and cyclohexane, using a dispersing machine. Suitable coating methods include a dip coating method, a spray coating method, a bead coating method, a ring coating method, and the like. The photosensitive layer 33 preferably has a thickness of from 5 to 25 μm.

The photoreceptor of the present invention can include an undercoat layer between the conductive substrate 31 and the photosensitive layer. The undercoat layer typically includes a resin as a main component. Since the photosensitive layer is typically formed on the undercoat layer by a wet coating method, the undercoat layer preferably has good resistance to the solvent included in the coating liquid of the photosensitive layer. Suitable resins for use in the undercoat layer include, but are not limited to, water-soluble resins such as polyvinyl alcohol, casein, and sodium polyacrylate; alcohol-soluble resins such as copolymer nylon and methoxymethylated nylon; and cured resins forming a three-dimensional network structure such as polyurethane, melamine resins, phenol resins, alkyd-melamine resins, and epoxy resins.

In addition, to prevent the occurrence of moiré and to decrease residual potential, the undercoat layer can include fine powders of metal oxides such as titanium oxide, silica, alumina, zirconium oxide, tin oxide, and indium oxide.

The undercoat layer can be prepared by a typical coating method using a proper solvent, in the same way as the preparation of the photosensitive layer. In addition, a metal oxide layer prepared by a sol-gel method using a silane coupling agent, a titan coupling agent, and a chrome coupling agent, etc. can be used as the undercoat layer. Furthermore, an alumina prepared by anodic oxidization; and thin films of organic materials such as polyparaxylylene (parylene) and inorganic materials such as $SiO_2$, $SnO_2$, $TiO_2$, ITO, and $CeO_2$ prepared by a vacuum method can also be used as the undercoat layer. The undercoat layer preferably has a thickness of from 0 to 5 μm.

The protective layer 39 can be optionally formed on the photosensitive layer to protect the photosensitive layer. Specific preferred examples of suitable binder resins used for the protective layer 39 include ABS resins, ACS resins, olefin-vinyl monomer copolymers, chlorinated polyether, aryl resins, phenol resins, polyacetal, polyamide, polyamideimide, polyacrylate, polyallylsulfone, polybutylene, polybutylene terephthalate, polycarbonate, polyethersulfone, polyethylene, polyethylene terephthalate, polyimide, acrylic resins, polymethylpentene, polypropylene, polyphenylene oxide, polysulfone, polystyrene, polyarylate, AS resins, butadiene-styrene copolymers, polyurethane, polyvinyl chloride, polyvinylidene chloride, and epoxy resins. Among these resins, polycarbonate and polyarylate are preferably used in consideration of dispersibility of a filler, residual potential, and coating defect.

The protective layer 39 further includes a filler to improve abrasion resistance. Specific preferred examples of suitable solvents used for the protective layer 39 include, but are not limited to, tetrahydrofuran, dioxane, toluene, dichloromethane, monochlorobenzene, dichloroethane, cyclohexanone, methyl ethyl ketone, and acetone, i.e., suitable solvents used for the charge transport layer 37. A high-viscosity solvent is preferable in view of dispersion treatment of a coating liquid, whereas a highly-volatile solvent is preferable in view of coating. If there is no solvent having both high viscosity and high volatile, 2 or more solvents can be used in combination. Solvents have an effect on dispersibility of a filler and residual potential.

Further, the protective layer 39 may optionally include an amine compound. Moreover, the above-described low-molecular-weight charge transport materials and charge transport polymers preferably used for the charge transport layer 37 may be added to the protective layer 39, to reduce residual potential and improve image quality.

The protective layer 39 can be formed by typical coating methods such as a dip coating method, a spray coating method, a bead coating method, a nozzle coating method, a spinner coating method, and a ring coating method. Among these methods, a spray coating method is preferably used in terms of uniformity of coating.

The photoreceptor of the present invention may optionally include an intermediate layer between the photosensitive layer and the protective layer 39. The intermediate layer typically includes a binder resin as a main component. Specific preferred examples of suitable binder resins include, but are not limited to, polyamide, alcohol-soluble nylon, water-soluble polyvinyl butyral, polyvinyl butyral, and polyvinyl alcohol. The intermediate layer can be formed by a typical coating method as described above. The intermediate layer preferably has a thickness of from 0.05 to 2 μm.

The charge generation layer, charge transport layer, photosensitive layer, undercoat layer, protective layer, and intermediate layer each may optionally include an antioxidant, a plasticizer, a lubricant, an ultraviolet absorber, and/or a leveling agent for the purpose of improving environmental stability, particularly preventing deterioration of sensitivity and increase of residual potential.

Specific examples of suitable antioxidants include the following compounds, but are not limited thereto.

(a) Phenol Compounds 2,6-di-t-butyl-p-cresol, butylated hydroxyanisole,
2,6-di-t-butyl-4-ethylphenol, n-octadecyl-3-(4'-hydroxy-3',5'-di-t-butylphenol),
2,2'-methylene-bis-(4-methyl-6-t-butylphenol),
2,2'-methylene-bis-(4-ethyl-6-t-butylphenol),
4,4'-thiobis-(3-methyl-6-t-butylphenol),
4,4'-butylidenebis-(3-methyl-6-t-butylphenol),
1,1,3-tris-(2-methyl-4-hydroxy-5-t-butylphenyl)butane,
1,3,5-trimethyl-2,4,6-tris(3,5-di-t-butyl-4-hydroxybenzyl) benzene,
tetrakis-[methylene-3-(3',5'-di-t-butyl-4'-hydroxyphenyl) propionate]methane,
bis[3,3'-bis(4'-hydroxy-3'-t-butylphenyl)butyric acid]glycol ester, tocopherols, etc.

(b) Paraphenylenediamines

N-phenyl-N'-isopropyl-p-phenylenediamine,
N,N'-di-sec-butyl-p-phenylenediamine,
N-phenyl-N-sec-butyl-p-phenylenediamine,
N,N'-di-isopropyl-p-phenylenediamine,
N,N'-dimethyl-N,N'-di-t-butyl-p-phenylenediamine, etc.

(c) Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur Compounds dilauryl-3,3'-thiodipropionate,
distearyl-3,3'-thiodipropionate,
ditetradecyl-3,3'-thiodipropionate, etc.

(e) Organic Phosphor Compounds triphenylphosphine, tri(nonylphenyl)phosphine, tri(dinonylphenyl)phosphine, tricresylphosphine, tri(2,4-dibutylohenoxy)phosphine, etc.

Specific examples of suitable plasticizers include the following compounds, but are not limited thereto.

(a) Phosphate Plasticizers triphenyl phosphate, tricresyl phosphate, trioctyl phosphate, octyl diphenyl phosphate, trichloroethyl phosphate, cresyl diphenyl phosphate, tributyl phosphate, tri-2-ethylhexyl phosphate, triphenyl phosphate, etc.

(b) Phthalate Plasticizers dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butyl benzyl phthalate, butyl lauryl phthalate, methyl oleyl phthalate, octyl decyl phthalate, dibutyl phthalate, dioctyl phthalate, etc.

(c) Aromatic Carboxylate Plasticizers trioctyl trimellitate, tri-n-octyl trimellitate, octyl oxybenzoate, etc.

(d) Dibasic Esters of Aliphatic Series dibutyl adipate, di-n-hexyl adipate, di-2-ethylhexyl adipate, n-octyl adipate, n-octyl-n-decyl adipate, diisodecyl adipate, dicapryl adipate, di-2-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, etc.

(e) Fatty Acid Ester Derivatives butyl oleate, glycerin monooleate, methyl acetylricinolate, pentaerythritol esters, dipentaerythritol hexaesters, triacetin, tributyrin, etc.

(f) Oxyacid Ester Plasticizers methyl acetylricinolate, butyl acetylricinolate, butyl phthalyl butyl glycolate, tributyl acetylcitrate, etc.

(g) Epoxy Plasticizers epoxidized soybean oil, epoxidized linseed oil, butyl epoxystearate, decyl epoxystearate, octyl epoxystearate, benzyl epoxystearate, dioctyl epoxyhexahydrophthalate, didecyl epoxyhexahydrophthalate, etc.

(h) Divalent Alcohol Ester Plasticizers diethylene glycol dibenzoate, triethylene glycol di-2-ethylbutyrate, etc.

(i) Chlorine-Containing Plasticizers chlorinated paraffin, chlorinated diphenyl, methyl esters of chlorinated fatty acids, methyl esters of methoxychlorinated fatty acids, etc.

(j) Polyester Plasticizers polypropylene adipate, polypropylene sebacate, polyester, acetylated polyester, etc.

(k) Sulfonic Acid Derivatives p-toluene sulfonamide, o-toluene sulfonamide, p-toluene sulfonethylamide, o-toluene sulfonethylamide, toluenesulfon-N-ethylamide, p-toluenesulfon-N-cyclohexylamide, etc.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, etc.

(m) Others terphenyl, partially hydrated terphenyl, camphor, 2-nitrodiphenyl, dinonyl naphthalene, methyl abietate, etc.

Specific examples of suitable lubricants include the following compounds, but are not limited thereto.

(a) Hydrocarbon Compounds liquid paraffin, paraffin wax, micro wax, low-polymerization polyethylene, etc.

(b) Fatty Acid Compounds lauric acid, myristic acid, palmitic acid, stearic acid, arachidic acid, behenic acid, etc.

(c) Fatty Acid Amide Compounds stearyl amide, palmitic acid amide, oleic acid amide, methylenebis stearamide, etc.

(d) Ester Compounds lower alcohol esters of fatty acids, polyol esters of fatty acids, polyglycol esters of fatty acids, etc.

(e) Alcohol Compounds cetyl alcohol, stearyl alcohol, ethylene glycol, polyethylene glycol, polyglycerol, etc.

(f) Metallic Soaps lead stearate, cadmium stearate, barium stearate, calcium stearate, zinc stearate, magnesium stearate, etc.

(g) Natural Waxes carnauba wax, candelilla wax, beeswax, spermaceti, insect wax, montan wax, etc.

(h) Others silicone compounds, fluorine compounds, etc.

Specific examples of suitable ultraviolet absorbers include the following compounds, but are not limited thereto.

(a) Benzophenones 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, etc.

(b) Salicylates phenyl salicylate, 2,4-di-t-butylphenyl-3,5-di-t-butyl-4-hydroxybenzoate, etc.

(c) Benzotriazoles (2'-hydroxyphenyl)benzotriazole, (2'-hydroxy-5'-methylphenyl)benzotriazole, (2'-hydroxy-3'-tert-butyl-5'-methylphenyl)5-chlorobenzotriazole, etc.

(d) Cyanoacrylates ethyl-2-cyano-3,3-diphenyl acrylate, methyl-2-carbomethoxy-3(paramethoxy) acrylate, etc.

(e) Quenchers (Metal Complexes)

nickel (2,2'-thiobis(4-t-octyl)phenolate)n-butylamine, nickel dibutyldithiocarbamate, cobalt dicyclohexyldithiophosphate, etc.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetramethylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, etc.

Next, an image forming apparatus according to example embodiments of the present invention will be described in detail.

Figure 7:
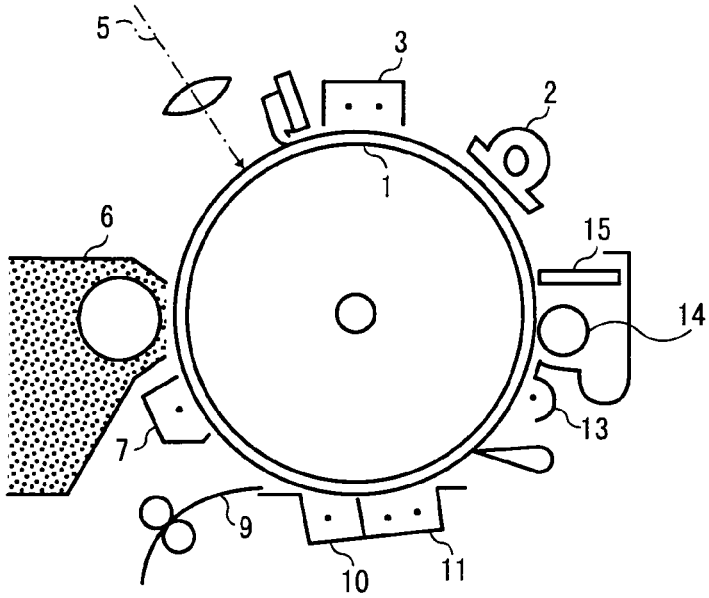
FIG. 7 is a schematic view illustrating an embodiment of an image forming apparatus of the present invention.

FIG. 7 is a schematic view illustrating an embodiment of an image forming apparatus of the present invention.

A photoreceptor 1 includes a photosensitive layer, and the outermost layer thereof includes a filler. The photoreceptor 1 has a drum-like shape, however, the photoreceptor may have a sheet-like shape or an endless-belt-like shape. As each of a charger 3, a pre-transfer charger 7, a transfer charger 10, a separation charger 11, and a pre-cleaning charger 13, any known chargers such as a corotron, a scorotron, a solid state charger, a charging roller can be used.

As a transfer device, any known chargers described above can be used. As illustrated in FIG. 7, the transfer device preferably includes the transfer charger 10 and the separation charger 11.

Suitable light sources used for an irradiator 5 and a decharging lamp 2 include illuminants such as fluorescent lamps, tungsten lamps, halogen lamps, mercury lamps, sodium lamps, light-emitting diodes (LED), laser diodes (LD), and electroluminescent lamps (EL). In addition, in order to obtain light having a desired wave length range, filters such as sharp-cut filters, band pass filters, near-infrared cutting filters, dichroic filters, interference filters, color temperature converting filters, and the like, can be used.

If a transfer process, a decharging process, and/or a cleaning process are performed along with light irradiation, or a pre-irradiation process is provided, the photoreceptor may be irradiated with light emitted by the above-described light sources.

A toner image is developed on the photoreceptor 1 by a developing unit 6, and subsequently transferred onto a transfer paper 9. Residual toner particles remaining on the photoreceptor 1 are removed using a fur brush 14 and a blade 15. The removal of residual toner particles may be performed using only a cleaning brush (such as the fur brush 14). As the cleaning brush, a fur brush, a magnet fur brush, and the like, can be used.

When an electrophotographic photoreceptor is positively (negatively) charged and irradiated, a positive (negative) electrostatic latent image is formed on the photoreceptor. When the positive (negative) electrostatic latent image is developed with a negatively (positively) chargeable toner, a positive image is produced. In contrast, when the positive (negative) electrostatic latent image is developed with a positively (negatively) chargeable toner, a negative image is produced.

Any known developing devices and decharging devices can be used for the present invention.

Figure 8:
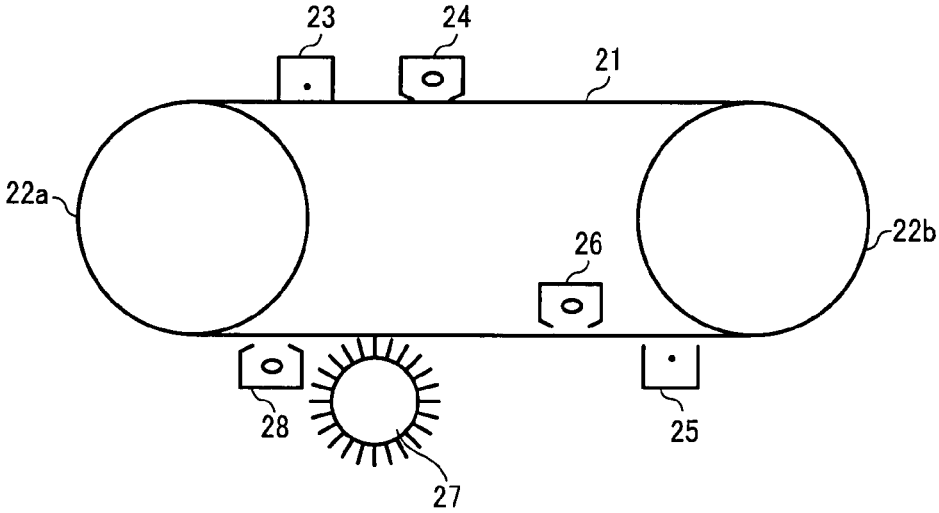
FIG. 8 is a schematic view illustrating another embodiment of an image forming apparatus of the present invention.

FIG. 8 is a schematic view illustrating another embodiment of an image forming apparatus of the present invention. A photoreceptor 21 includes a photosensitive layer, and the outermost layer thereof includes a filler. The photoreceptor 21 is driven by driving rollers 22*a* and 22*b*, charged by a charger 23, and irradiated by an image irradiator 24. A toner image is formed on the photoreceptor 21 by a developing device, not shown, and transferred onto a transfer paper, not shown, by a transfer charger 25. The photoreceptor 21 is then irradiated by a pre-cleaning irradiator 26, cleaned by a brush 27, and decharged by a decharging irradiator 28. The above-described operation is repeatedly performed. As illustrated in FIG. 8, the photoreceptor 21 is irradiated by the pre-cleaning irradiator 26 from a side on which the substrate is provided. In this case, of course, the substrate is translucent.

Alternatively, the pre-cleaning irradiator 26 may irradiate the photoreceptor 21 from a side on which the photosensitive layer is provided, and each of the image irradiator 24 and the decharging irradiator 28 may irradiate the photoreceptor 21 from a side on which a substrate is provided.

Furthermore, other than the image irradiation process, the pre-cleaning irradiation process, and the decharging irradiation process, the photoreceptor 21 may be also irradiated preliminary to the transfer process or in the image irradiation process.

Figure 9:
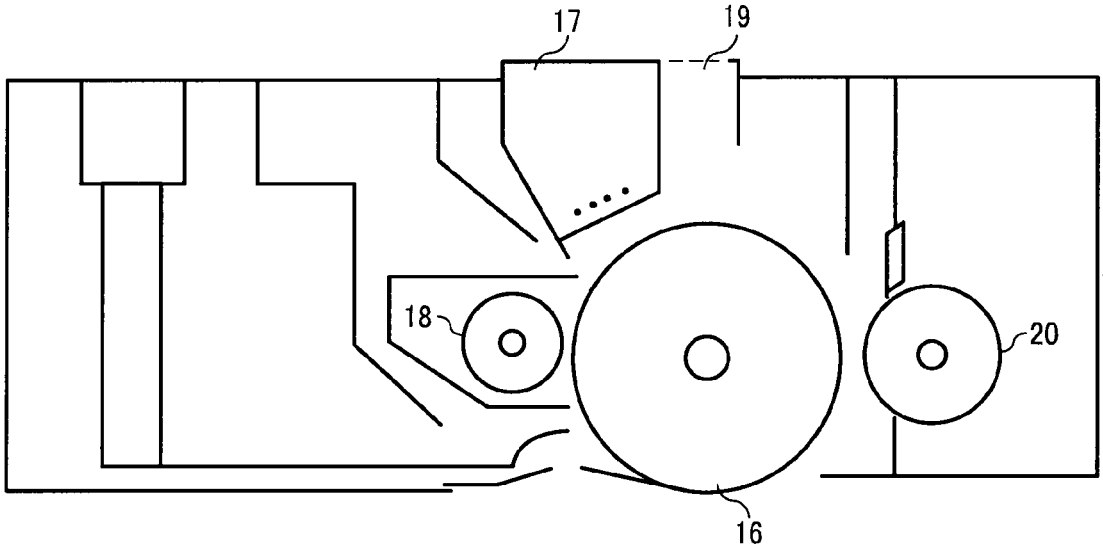
FIG. 9 is a schematic view illustrating an embodiment of a process cartridge of the present invention.

The above-described image forming devices may be fixedly mounted on an image forming apparatus such as a copier, a facsimile, and a printer. Alternatively, the above-described image forming devices may be integrally combined as a process cartridge. A typical process cartridge is a single device (i.e., component) including a photoreceptor, a charger, an irradiator, a developing device, a transfer device, a cleaning device, and a diselectrification device. FIG. 9 is a schematic view illustrating an embodiment of a process cartridge of the present invention, including a photoreceptor 16 which is a photoreceptor according to an example embodiment of the present invention, a charger 17, a cleaning brush 18, an image irradiator 19, and a developing roller 20.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example 1

Preparation of Compound No. 20

A mixture of 2.68 g (10.0 mmol) of naphthalene-1,4,5,8-tetracarboxylic acid dianhydride (from Tokyo Chemical Industry Co., Ltd.), 30 ml of N,N'-dimethylformamide, and 3.68 g (20.0 mmol) of 1,1-diphenylhydrazine (from Tokyo Chemical Industry Co., Ltd.) was agitated for 2 hours at 60° C. under an argon gas stream, and 100 ml of water were added thereto. The precipitated crystals were collected by filtration, and dried in a reduced-pressure heating drier. Thus, 3.43 g (i.e., the yield was 57.1%) of brown crude crystals were prepared. The brown crude crystals was then treated with a silica gel column, using a mixed solvent of toluene and ethyl acetate in a volume ratio of 20/1 as eluant, recrystallized with toluene, and dried in a reduced-pressure heating drier. Thus, 7.02 g (i.e., the yield was 29.7%) of orange-red crystals of the compound No. 20 having the following formula were prepared:

(No. 20)

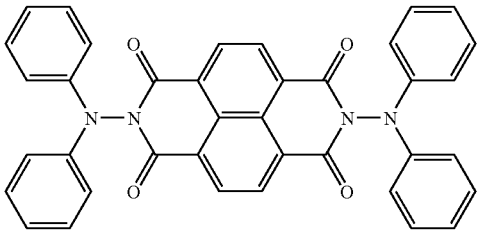

The result of ultimate analysis is shown in Table 1.

TABLE 1

| | Ultimate Analysis (%) | | |
|---|---|---|---|
| | C | H | N |
| Measured Value | 76.05 | 4.02 | 9.20 |
| (Calculated Value) | (75.99) | (4.03) | (9.33) |

To measure the decomposition point, which is a temperature at which an exothermic peak in DTA is observed along with weight loss in TG, the above-prepared compound was subjected to a measurement using a Thermo-Gravimetric/Differential Thermal Analyzer TG/DTA 6200 (from Seiko Instruments Inc.), in which a sample was heated at a temperature rising rate of 10° C./min under a nitrogen gas stream. The above-prepared compound has a decomposition point of 341° C.

Figure 10:
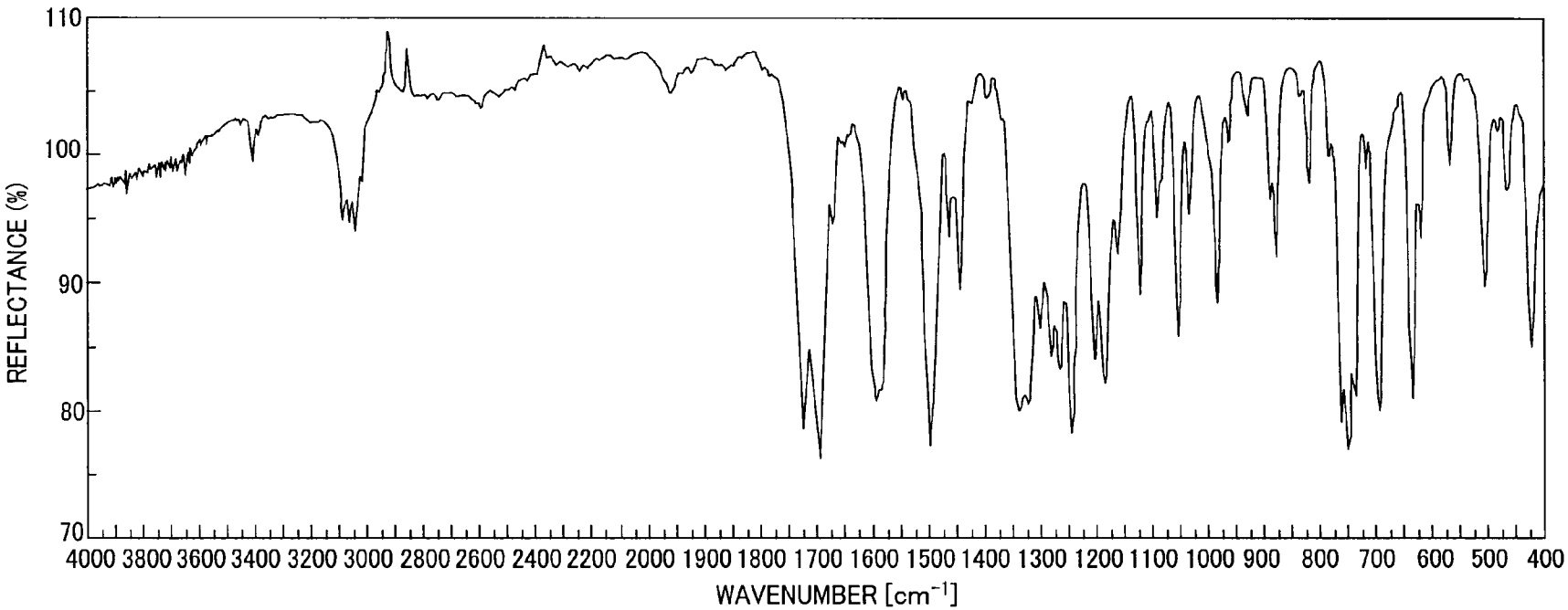
FIGS. 10 to 15 are infrared absorption spectrums of naphthalenetetracarboxylic acid diimide derivatives used for the electrophotographic photoreceptor of the present invention.
Figure 11:
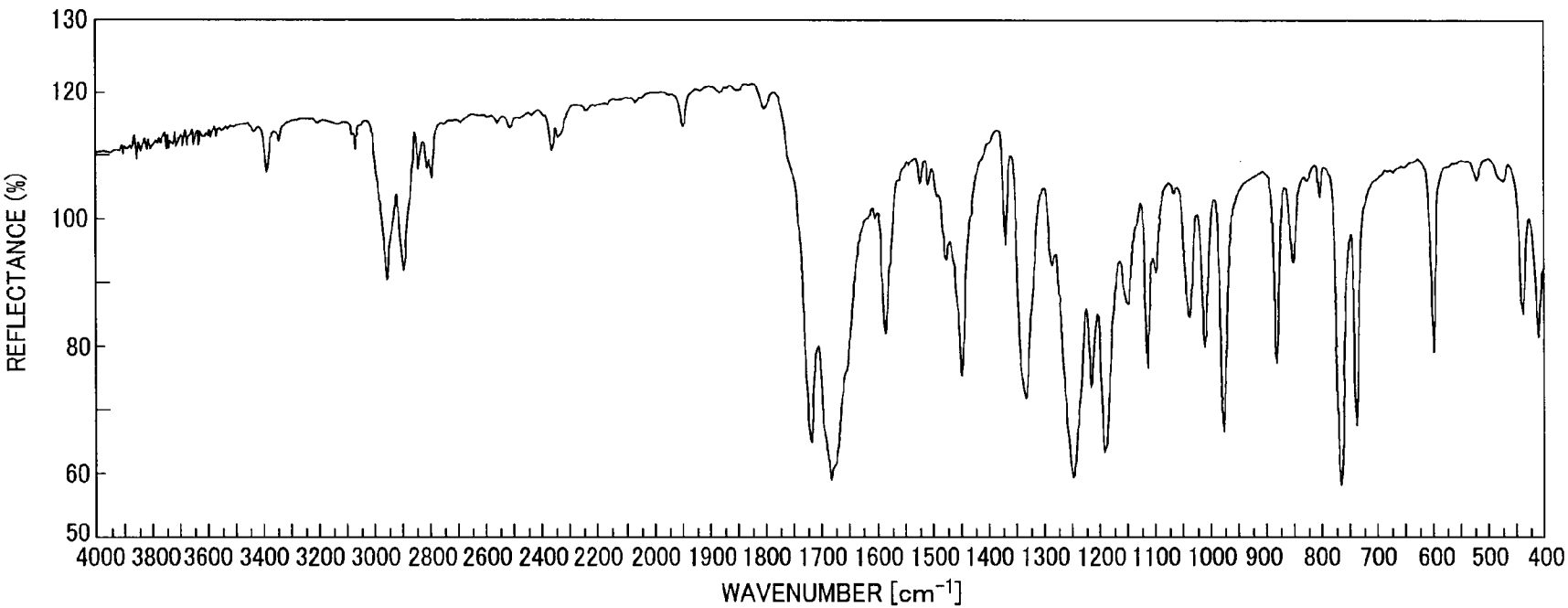
Figure 12:
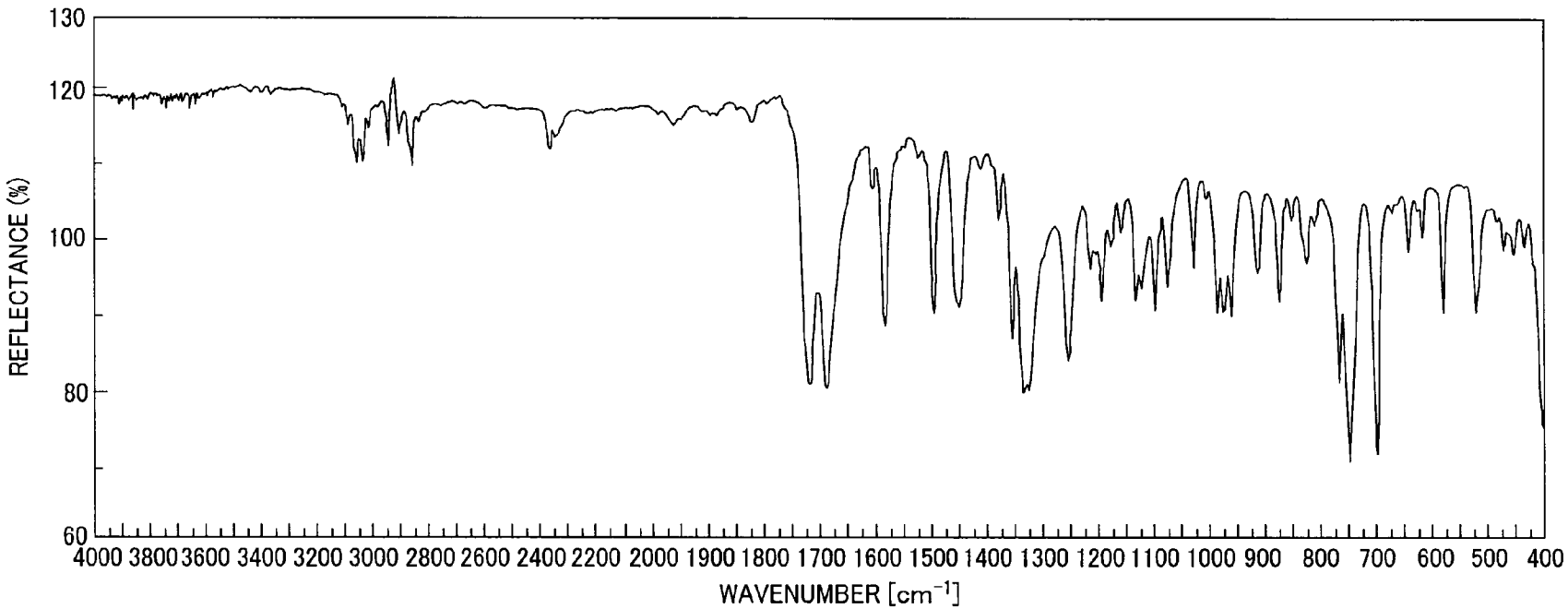
Figure 13:
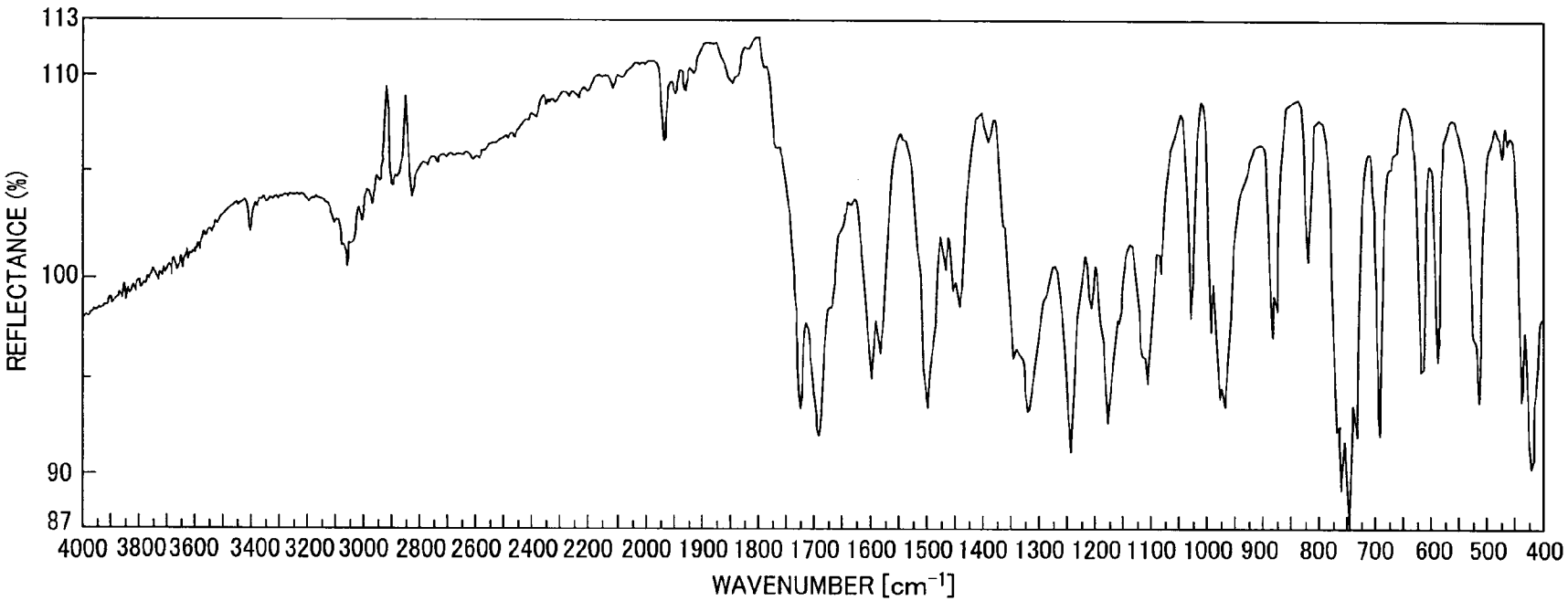
Figure 14:
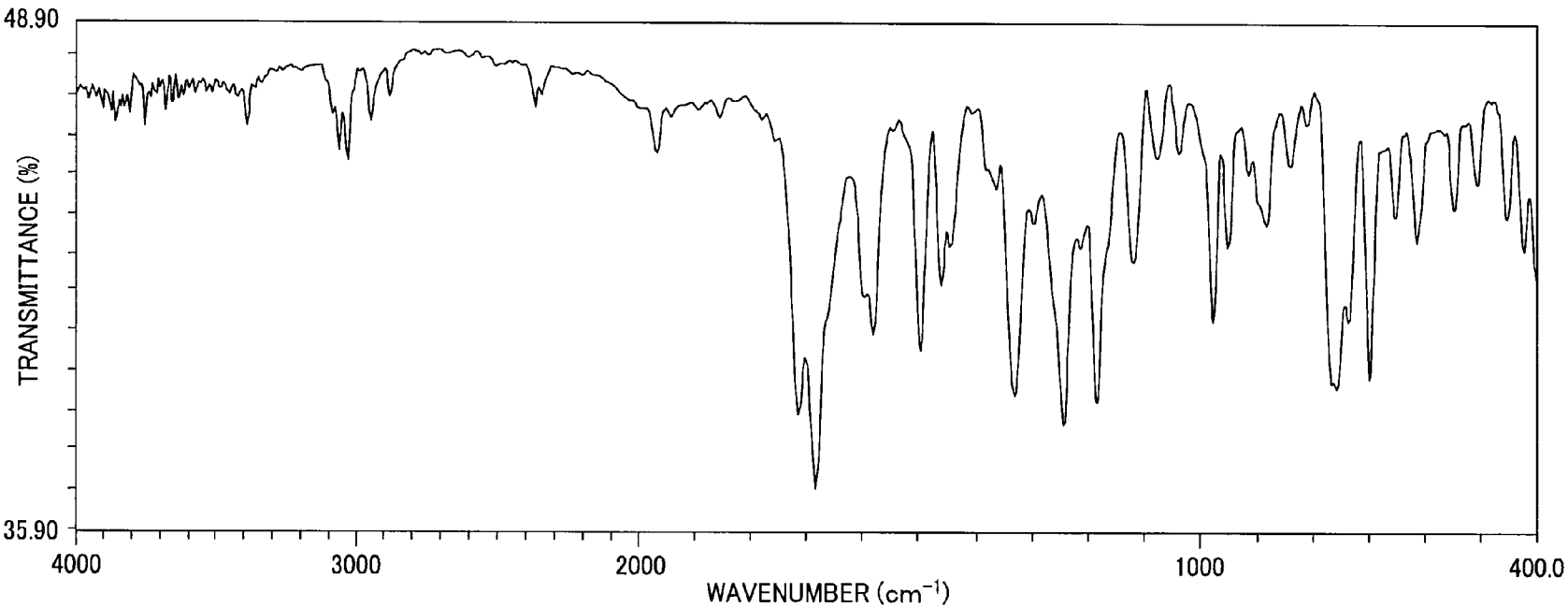

The infrared absorption spectrum, measured by a KBr pellet method, is shown in FIG. 10.

Manufacturing Examples 2 to 5

Preparation of Compounds Nos. 1, 10, 15, and 37

The procedure for preparation of the compound No. 20 in Manufacturing Example 1 was repeated except that the hydrazine compound (i.e., 1,1-diphenylhydrazine) was replaced with other compounds. Thus, the compounds Nos. 1, 10, 15, and 37 were prepared.

The measurement results of these compounds are shown in Table 2. The infrared absorption spectrums, measured by a KBr pellet method, are shown in FIGS. 11 to 14.

TABLE 2

| Manufacturing Example | Compound | Yield | Decomposition Point | Ultimate Analysis (%) Measured Value (Calculated Value) | | |
|---|---|---|---|---|---|---|
| No. | No. | (%) | (° C.) | C | H | N |
| 2 | 1 | 37.4 | 328 | 61.28 | 4.52 | 15.84 |
| | | | | (61.36) | (4.58) | (15.90) |
| 3 | 10 | 61.3 | 352 | 76.90 | 4.90 | 8.78 |
| | | | | (76.81) | (4.91) | (8.53) |
| 4 | 15 | 56.5 | 380 | 70.68 | 4.10 | 11.98 |
| | | | | (70.58) | (4.23) | (11.76) |
| 5 | 37 | 46.5 | 362 | 76.22 | 4.36 | 9.02 |
| | | | | (76.42) | (4.49) | (8.91) |

Manufacturing Example 6

Preparation of Compound No. 38

A mixture of 2.68 g (10.0 mmol) of naphthalene-1,4,5,8-tetracarboxylic acid dianhydride (from Tokyo Chemical Industry Co., Ltd.) and 25 ml of N,N'-dimethylformamide was agitated at 80° C. under an argon gas stream. A solution including 0.61 g (10 mmol) of 1-methyl-1-phenylhydrazine (from Tokyo Chemical Industry Co., Ltd.) and 10 ml of N,N'-dimethylformamide was dropped therein over a period of 2 hours. The mixture was further agitated for 30 minutes at 80° C., and subsequently a solution including 0.99 g (10 mmol) of 1-benzyl-1-phenylhydrazine (from Tokyo Chemical Industry Co., Ltd.) and 5 ml of N,N'-dimethylformamide was added thereto. The mixture was further agitated for 2 hours at 80° C. The mixture was poured into 100 ml of water, and the precipitated crystals were collected by filtration, and dried in a reduced-pressure heating drier. Thus, brown crude crystals were prepared. The brown crude crystals were then treated with a silica gel column, using a mixed solvent of toluene and ethyl acetate in a volume ratio of 20/1 as eluant, recrystallized with a mixed solvent of toluene and ethanol, and dried in a reduced-pressure heating drier. Thus, 2.29 g (i.e., the yield was 41.4%) of reddish-brown crystals of the compound No. 38 having the following formula were prepared:

(No. 38)

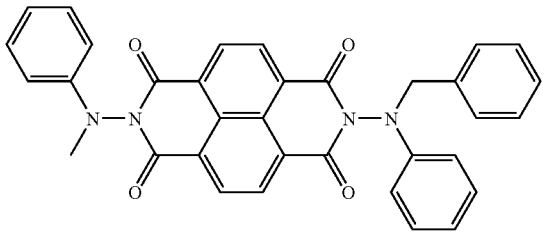

The compound No. 38 has a melting point of from 279.5 to 280.5° C.

The result of ultimate analysis is shown in Table 3.

TABLE 3

| | Ultimate Analysis (%) | | |
|---|---|---|---|
| | C | H | N |
| Measured Value | 73.75 | 4.12 | 10.22 |
| (Calculated Value) | (73.90) | (4.38) | (10.14) |

Figure 15:
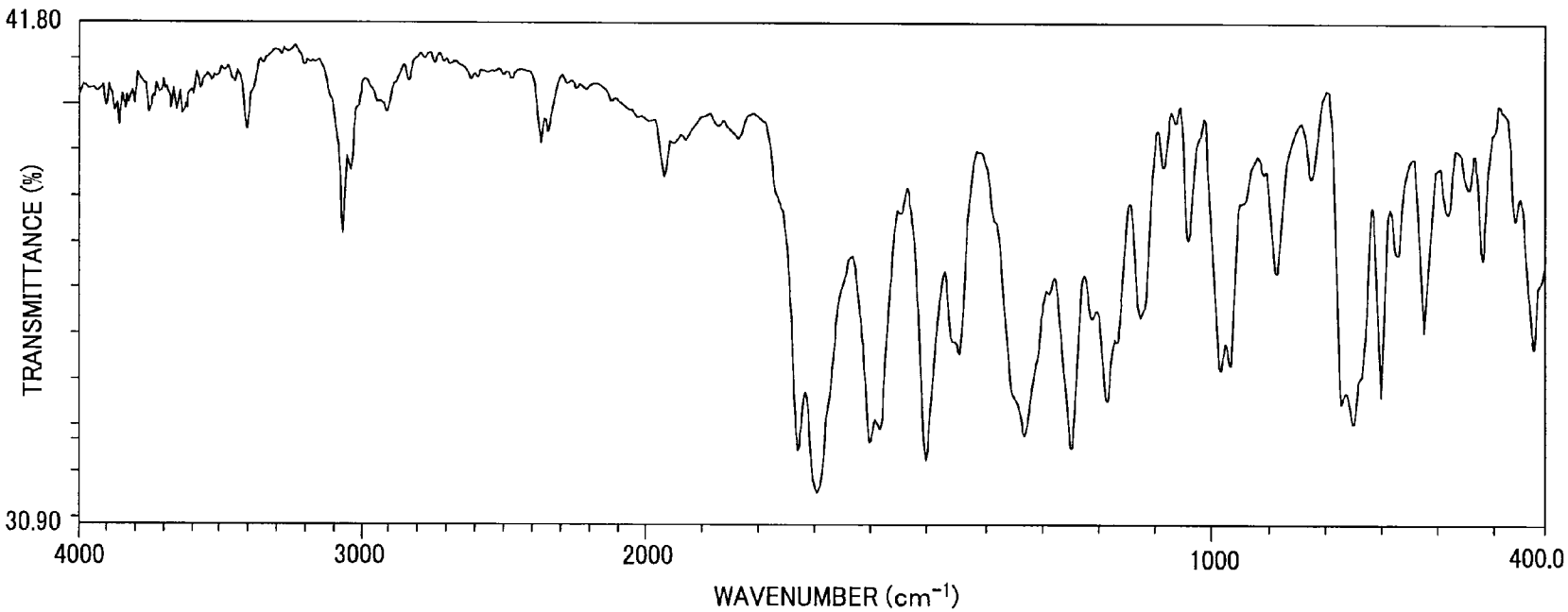

The infrared absorption spectrum, measured by a KBr pellet method, is shown in FIG. 15.

Example 1

An undercoat layer coating liquid, a charge generation layer coating liquid, and a charge transport layer coating liquid, each having the following compositions, were successively applied to an aluminum cylinder and dried in an oven, in this order. Thus, a photoreceptor No. 1 including an undercoat layer having a thickness of 3.5 μm, a charge generation layer having a thickness of 0.2 μm, and a charge transport layer having a thickness of 23 μm was prepared.

| (Composition of Undercoat Layer Coating Liquid) | |
|---|---|
| Titanium dioxide powder (TIPAQUE CR-EL from Ishihara Sangyo Kaisha Ltd.) | 400 parts |
| Melamine resin (SUPER BECKAMINE G821-60 from DIC Corporation) | 65 parts |
| Alkyd resin (BECKOLITE M6401-50 from DIC Corporation) | 120 parts |
| 2-Butanone | 400 parts |

| (Composition of Charge Generation Layer Coating Liquid) | |
|---|---|
| Fluorenone bisazo pigment (having the following formula) | 12 parts |

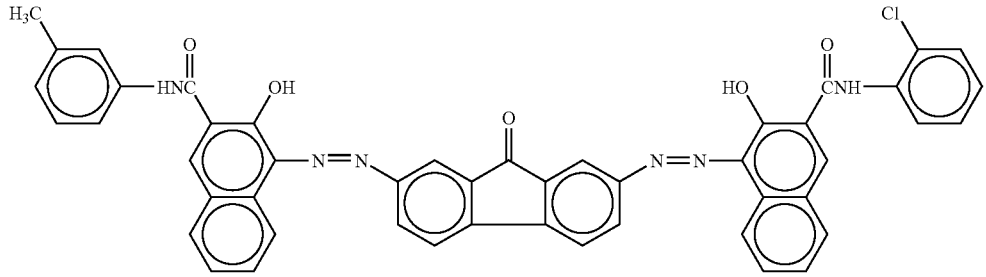

| | |
|---|---|
| Polyvinyl butyral (XYHL from Union Carbide Corporation) | 5 parts |
| 2-Butanone | 200 parts |
| Cyclohexanone | 400 parts |

| (Composition of Charge Transport Layer Coating Liquid) | |
|---|---|
| Polycarbonate Resin (Z-form polycarbonate resin from Teijin Chemicals Ltd.) | 10 parts |
| Naphthalenetetracarboxylic acid diimide derivative compound No. 4 | 10 parts |
| Tetrahydrofuran | 100 parts |

The above-prepared photoreceptor No. 1 was mounted on a process cartridge, and the process cartridge was mounted on a modified image forming apparatus IMAGIO MF2200 (manufactured and modified by Ricoh Co., Ltd.) in which the charging method was changed to a positively chargeable corona charging method and the light source for the image irradiation was changed to a laser diode having a wavelength of 655 nm. At first, the dark section potential was set to 800 V. A running test in which 100,000 sheets of an image are continuously produced was performed. The bright section potential was measured and the produced image was evaluated before and after the running test was performed. To evaluate image blurring (i.e., dot resolution), 10 sheets of a dot image having a pixel of 600 dpi×600 dpi and an image density of 5% were continuously produced.

The produced dot image was observed using a stereomicroscope and graded as follows:

5: Sharply-defined. Very good.

4: Very slightly vaguely-outlined. Good.

3: Slightly vaguely-outlined. Average

2: Vaguely-outlined. Poor.

1: Impossible to determine dots. Very poor.

The evaluation results are shown in Table 4.

Examples 2 to 15

The procedure for preparation and evaluation of the photoreceptor No. 1 in Example 1 was repeated except that the naphthalenetetracarboxylic acid diimide derivative compound No. 4 was replaced with the compounds described in Table 4, respectively. Thus, photoreceptors Nos. 2 to 15 were prepared. The evaluation results are shown in Table 4.

TABLE 4

| | | | Initial stage | | After printing 100,000 sheets | |
|---|---|---|---|---|---|---|
| Ex. | Photoreceptor No. | Compound No. | Bright Section Potential (V) | Dot Resolution | Bright Section Potential (V) | Dot Resolution |
| 1 | 1 | 4 | 105 | 5 | 125 | 5 |
| 2 | 2 | 2 | 110 | 5 | 135 | 5 |

TABLE 4-continued

| Ex. | Photoreceptor No. | Compound No. | Initial stage: Bright Section Potential (V) | Initial stage: Dot Resolution | After printing 100,000 sheets: Bright Section Potential (V) | After printing 100,000 sheets: Dot Resolution |
|---|---|---|---|---|---|---|
| 3 | 3 | 3 | 100 | 5 | 130 | 4 |
| 4 | 4 | 5 | 95 | 5 | 120 | 5 |
| 5 | 5 | 7 | 100 | 5 | 115 | 4 |
| 6 | 6 | 9 | 105 | 5 | 135 | 5 |
| 7 | 7 | 10 | 105 | 5 | 130 | 5 |
| 8 | 8 | 13 | 125 | 5 | 155 | 4 |
| 9 | 9 | 15 | 100 | 5 | 120 | 5 |
| 10 | 10 | 17 | 125 | 5 | 155 | 4 |
| 11 | 11 | 20 | 100 | 5 | 145 | 4 |
| 12 | 12 | 23 | 115 | 5 | 140 | 5 |
| 13 | 13 | 25 | 105 | 5 | 150 | 3 |
| 14 | 14 | 30 | 110 | 5 | 130 | 5 |
| 15 | 15 | 34 | 100 | 5 | 135 | 5 |

Example 16

The procedure for preparation of the photoreceptor No. 1 in Example 1 was repeated except that the charge transport layer coating liquid was replaced with another charge transport layer coating liquid having the following composition:

| | |
|---|---|
| Polycarbonate resin (Z-form polycarbonate resin from Teijin Chemicals Ltd.) | 10 parts |
| Naphthalenetetracarboxylic acid diimide derivative compound No. 4 | 1 part |
| Charge transport material (CTM1 having the following formula) | 9 parts |

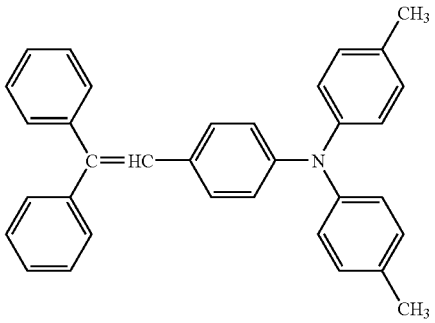

(CTM1)

| | |
|---|---|
| Tetrahydrofuran | 100 parts |

Thus, a photoreceptor No. 16 was prepared.

The photoreceptor No. 16 was evaluated in the same way as the photoreceptor No. 1 in Example 1 except for replacing the positively chargeable corona charging method with a negatively chargeable corona charging method (i.e., scorotron charging method). The evaluation results are shown in Table 5.

Examples 17 to 30

The procedure for preparation and evaluation of the photoreceptor No. 16 in Example 16 was repeated except that the naphthalenetetracarboxylic acid diimide derivative compound No. 4 was replaced with the compounds described in Table 5, respectively. Thus, photoreceptors Nos. 17 to 30 were prepared. The evaluation results are shown in Table 5.

TABLE 5

| Ex. | Photoreceptor No. | Compound No. | Initial stage: Bright Section Potential (V) | Initial stage: Dot Resolution | After printing 100,000 sheets: Bright Section Potential (V) | After printing 100,000 sheets: Dot Resolution |
|---|---|---|---|---|---|---|
| 16 | 16 | 4 | −95 | 5 | −120 | 5 |
| 17 | 17 | 2 | −100 | 5 | −110 | 5 |
| 18 | 18 | 3 | −100 | 5 | −105 | 5 |
| 19 | 19 | 5 | −95 | 5 | −105 | 5 |
| 20 | 20 | 7 | −105 | 5 | −115 | 5 |
| 21 | 21 | 9 | −100 | 5 | −110 | 5 |
| 22 | 22 | 10 | −100 | 5 | −115 | 5 |
| 23 | 23 | 13 | −100 | 5 | −105 | 4 |
| 24 | 24 | 15 | −105 | 5 | −105 | 5 |
| 25 | 25 | 17 | −105 | 5 | −110 | 5 |
| 26 | 26 | 20 | −100 | 5 | −105 | 5 |
| 27 | 27 | 23 | −115 | 5 | −125 | 5 |
| 28 | 28 | 25 | −100 | 5 | −115 | 5 |
| 29 | 29 | 30 | −105 | 5 | −110 | 4 |
| 30 | 30 | 34 | −100 | 5 | −105 | 5 |

Examples 31 to 34

The procedure for preparation and evaluation of the photoreceptor No. 16 in Example 16 was repeated except that the naphthalenetetracarboxylic acid diimide derivative compound No. 4 was replaced with the compounds described in Table 6, respectively; and the amount of the charge transport material (CTM1) was changed to 7 parts. Thus, photoreceptors Nos. 31 to 34 are prepared. The evaluation results are shown in Table 6.

TABLE 6

| Ex. | Photoreceptor No. | Compound No. | Initial stage: Bright Section Potential (V) | Initial stage: Dot Resolution | After printing 100,000 sheets: Bright Section Potential (V) | After printing 100,000 sheets: Dot Resolution |
|---|---|---|---|---|---|---|
| 31 | 31 | 7 | −100 | 5 | −105 | 5 |
| 32 | 32 | 9 | −100 | 5 | −105 | 5 |
| 33 | 33 | 17 | −105 | 5 | −115 | 4 |
| 34 | 34 | 25 | −105 | 5 | −110 | 5 |

Examples 35 to 38

The procedures for preparation and evaluation of the photoreceptors Nos. 31 to 34 in Examples 31 to 34 were repeated except that the charge transport material (CTM1) was replaced with another charge transport material (CTM2) having the following formula:

(CTM2)

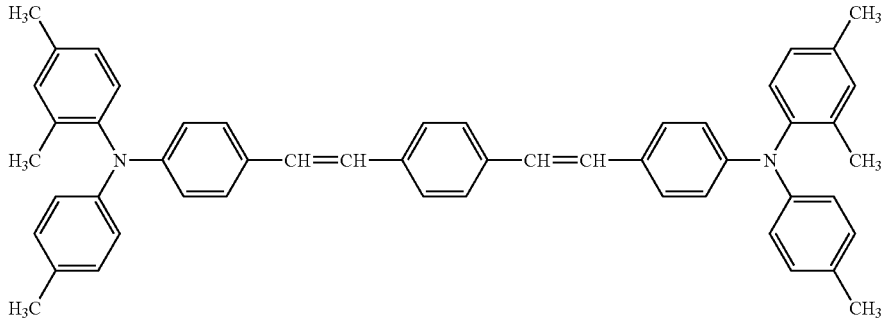

Thus, photoreceptors Nos. 35 to 38 were prepared. The evaluation results are shown in Table 7.

TABLE 7

| Ex. | Photoreceptor No. | Compound No. | Initial stage Bright Section Potential (V) | Initial stage Dot Resolution | After printing 100,000 sheets Bright Section Potential (V) | After printing 100,000 sheets Dot Resolution |
|---|---|---|---|---|---|---|
| 35 | 35 | 7 | −100 | 5 | −105 | 5 |
| 36 | 36 | 9 | −100 | 5 | −105 | 5 |
| 37 | 37 | 17 | −105 | 5 | −115 | 4 |
| 38 | 38 | 25 | −105 | 5 | −110 | 5 |

Examples 39 to 42

The procedures for preparation and evaluation of the photoreceptors Nos. 31 to 34 in Examples 31 to 34 were repeated except that the charge transport material (CTM1) was replaced with another charge transport material (CTM3) having the following formula:

(CTM3)

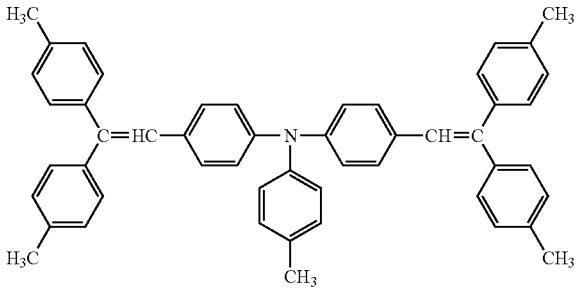

Thus, photoreceptors Nos. 39 to 42 were prepared. The evaluation results are shown in Table 8.

TABLE 8

| Ex. | Photoreceptor No. | Compound No. | Initial stage Bright Section Potential (V) | Initial stage Dot Resolution | After printing 100,000 sheets Bright Section Potential (V) | After printing 100,000 sheets Dot Resolution |
|---|---|---|---|---|---|---|
| 39 | 39 | 7 | −100 | 5 | −110 | 5 |
| 40 | 40 | 9 | −100 | 5 | −105 | 5 |
| 41 | 41 | 17 | −105 | 5 | −100 | 4 |
| 42 | 42 | 25 | −100 | 5 | −115 | 5 |

Examples 43 to 46

The procedures for preparation and evaluation of the photoreceptors Nos. 31 to 34 in Examples 31 to 34 were repeated except that the charge transport material (CTM1) was replaced with another charge transport material (CTM4) having the following formula:

(CTM4)

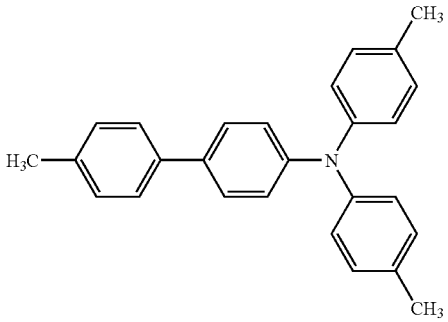

Thus, photoreceptors Nos. 43 to 46 were prepared. The evaluation results are shown in Table 9.

TABLE 9

| Ex. | Photoreceptor No. | Compound No. | Initial stage Bright Section Potential (V) | Initial stage Dot Resolution | After printing 100,000 sheets Bright Section Potential (V) | After printing 100,000 sheets Dot Resolution |
|---|---|---|---|---|---|---|
| 43 | 43 | 7 | −100 | 5 | −110 | 5 |
| 44 | 44 | 9 | −105 | 5 | −115 | 5 |

TABLE 9-continued

| Ex. | Photoreceptor No. | Compound No. | Initial stage Bright Section Potential (V) | Initial stage Dot Resolution | After printing 100,000 sheets Bright Section Potential (V) | After printing 100,000 sheets Dot Resolution |
|---|---|---|---|---|---|---|
| 45 | 45 | 17 | −105 | 5 | −120 | 4 |
| 46 | 46 | 25 | −105 | 5 | −120 | 5 |

Examples 47 and 48

The procedure for preparation and evaluation of the photoreceptor No. 16 in Example 16 was repeated except that the charge generation layer coating liquid and the charge transport layer coating liquid were replaced with another charge generation layer coating liquid and charge transport layer coating liquid, respectively, each having the following compositions. Thus, photoreceptors Nos. 47 and 48 were prepared. The evaluation results are shown in Table 10.

(Synthesis of Oxotitanium Phthalocyanine)

Figure 16:
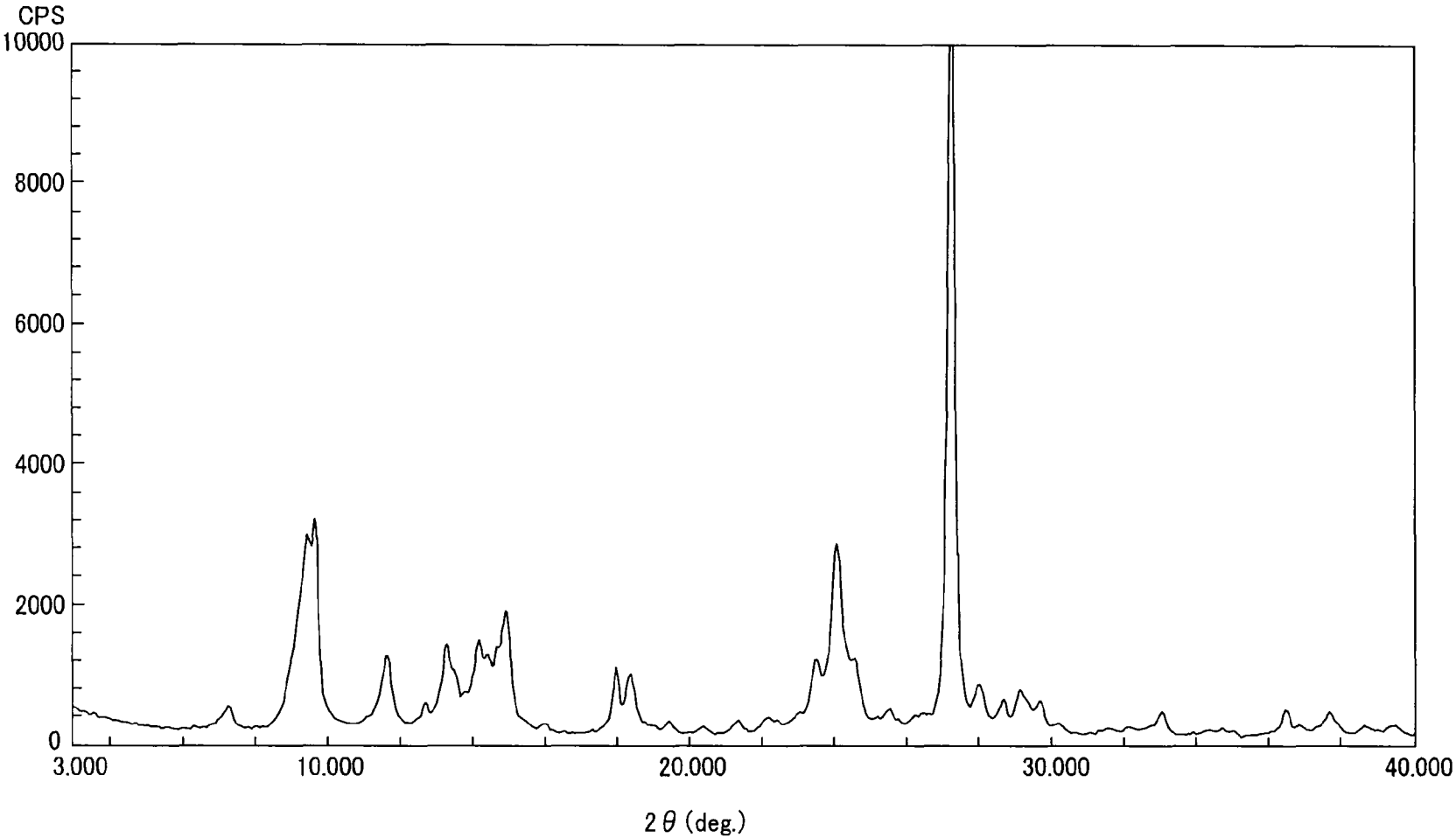
FIG. 16 is an X-ray diffraction spectrum of an oxotitanium phthalocyanine used for the electrophotographic photoreceptor of the present invention.

An oxotitanium phthalocyanine was synthesized with reference to Synthesis Example 4 in JP-A 2001-019871 as follows. At first, 29.2 g of 1,3-diiminoisoindoline and 200 ml of sulfolane were mixed, and 20.4 g of titanium tetrabutoxide was dropped therein under a nitrogen airflow. The mixture was gradually heated to 180° C., and agitated for 5 hours while keeping a temperature to from 170 to 180° C. so that a reaction was performed. After the reaction was terminated, the mixture stood to cool. The cooled mixture was filtered, and the deposited substance was washed with chloroform until expressing blue color. Subsequently, the precipitated substance was washed with methanol for several times, washed with hot water having a temperature of 80° C. for several times, and dried. Thus, a crude titanyl phthalocyanine was prepared. The crude titanyl phthalocyanine was dissolved in concentrated sulfuric acid 20 times the amount thereof, and subsequently dropped in ice water 100 times the amount thereof while being agitated. The mixture was filtered, and the deposited crystal was washed with water until the used water becomes neutral. Thus, a wet cake (i.e., a water paste) of a titanyl phthalocyanine was prepared. An X-ray diffraction spectrum of the dried wet cake is shown in FIG. 16. Next, 2 g of the wet cake was poured into 20 g of carbon disulfide, and the mixture was agitated for 4 hours. Subsequently, 100 g of methanol was added thereto, and the mixture was further agitated for 1 hour. Finally, the mixture was filtered and dried. Thus, a titanyl phthalocyanine crystal powder was prepared.

| (Composition of Charge Generation Layer Coating Liquid) | |
|---|---|
| Oxotitanium phthalocyanine (having an X-ray diffraction spectrum shown in FIG. 16) | 8 parts |

-continued

| (Composition of Charge Generation Layer Coating Liquid) | |
|---|---|
| Polyvinyl butyral (BX-1) | 5 parts |
| 2-Butanone | 400 parts |

| (Composition of Charge Transport Layer Coating Liquid) | |
|---|---|
| Polycarbonate resin (Z-form polycarbonate resin from Teijin Chemicals Ltd.) | 10 parts |
| Naphthalenetetracarboxylic acid diimide derivative compound No. 4 | 1 part |
| Charge transport material (CTM1 having the following formula) | 7 parts |

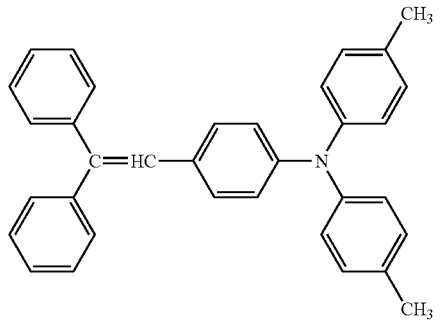

(CTM1)

| | |
|---|---|
| Toluene | 70 parts |

TABLE 10

| Ex. | Photoreceptor No. | Compound No. | Initial stage Bright Section Potential (V) | Initial stage Dot Resolution | After printing 100,000 sheets Bright Section Potential (V) | After printing 100,000 sheets Dot Resolution |
|---|---|---|---|---|---|---|
| 47 | 47 | 7 | −115 | 5 | −130 | 5 |
| 48 | 48 | 30 | −110 | 5 | −125 | 4 |

Example 49

A photosensitive layer coating liquid having the following composition was applied to an aluminum cylinder having a diameter of 100 mm and dried. Thus, a photoreceptor No. 49 including a single-layered photosensitive layer having a thickness of 30 μm was prepared.

| (Composition of Photosensitive Layer Coating Liquid) | |
|---|---|
| X-type metal-free phthalocyanine (FASTOGEN BLUE 8120B from DIC Corporation) | 2 parts |
| Charge transport material (CTM2 having the following formula) | 30 parts |

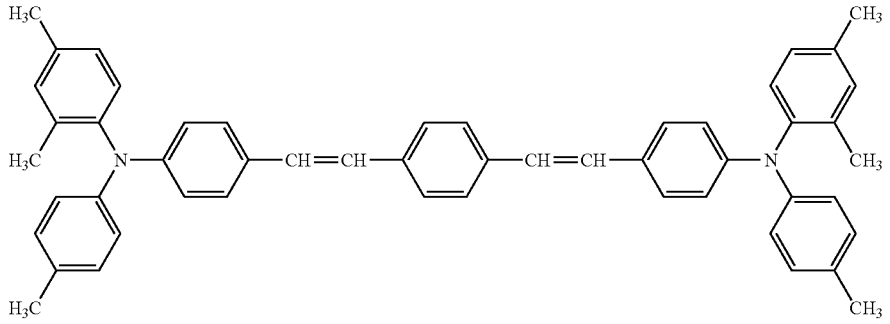

(CTM2)

| | |
|---|---|
| Naphthalenetetracarboxylic acid diimide derivative compound No. 7 | 20 parts |
| Bisphenol Z polycarbonate (PANLITE TS-2050 from Teijin Chemicals Ltd.) | 50 parts |
| Tetrahydrofuran | 500 parts |

The above-prepared photoreceptor No. 49 was mounted on a modified image forming apparatus IMAGIO NEO 752 (manufactured and modified by Ricoh Co., Ltd.) in which the charging method was changed to a scorotron corona charging method and the light source for the image irradiation was changed to a laser diode having a wavelength of 780 nm. At first, the dark section potential was set to +700 V. A running test in which 100,000 sheets of an image are continuously produced was performed. The bright section potential was measured and the produced image was evaluated before and after the running test was performed. Image blurring (i.e., dot resolution) was evaluated in the same way as in Example 1. The evaluation results are shown in Table 11.

Examples 50 to 52

The procedure for preparation and evaluation of the photoreceptor No. 49 in Example 49 was repeated except that the naphthalenetetracarboxylic acid diimide derivative compound No. 7 was replaced with the compounds described in Table 11, respectively. Thus, photoreceptors Nos. 50 to 52 were prepared. The evaluation results are shown in Table 11.

TABLE 11

| | | | Initial stage | | After printing 100,000 sheets | |
|---|---|---|---|---|---|---|
| Ex. | Photoreceptor No. | Compound No. | Bright Section Potential (V) | Dot Resolution | Bright Section Potential (V) | Dot Resolution |
| 49 | 49 | 7 | 100 | 5 | 115 | 5 |
| 50 | 50 | 9 | 105 | 5 | 115 | 5 |
| 51 | 51 | 17 | 100 | 5 | 110 | 4 |
| 52 | 52 | 25 | 105 | 5 | 120 | 5 |

Example 53

The photosensitive layer coating liquid prepared in Example 49 was applied to an aluminum cylinder having a diameter of 30 mm and dried. Thus, a photoreceptor No. 53 including a single-layered photosensitive layer having a thickness of 30 μm was prepared.

The photoreceptor No. 53 was evaluated in the same way as the photoreceptor No. 16 in Example 16. The evaluation results are shown in Table 12.

Examples 54 to 56

The procedure for preparation and evaluation of the photoreceptor No. 53 in Example 53 was repeated except that the naphthalenetetracarboxylic acid diimide derivative compound No. 7 was replaced with the compounds described in Table 12, respectively. Thus, photoreceptors Nos. 54 to 56 were prepared. The evaluation results are shown in Table 12.

TABLE 12

| | | | Initial stage | | After printing 100,000 sheets | |
|---|---|---|---|---|---|---|
| Ex. | Photoreceptor No. | Compound No. | Bright Section Potential (V) | Dot Resolution | Bright Section Potential (V) | Dot Resolution |
| 53 | 53 | 7 | −100 | 5 | −125 | 5 |
| 54 | 54 | 9 | −100 | 5 | −130 | 4 |
| 55 | 55 | 17 | −100 | 5 | −110 | 4 |
| 56 | 56 | 25 | −110 | 5 | −135 | 4 |

Example 57

A charge transport layer coating liquid and a charge generation layer coating liquid, each having the following compositions, were successively applied to an aluminum cylinder having a diameter of 100 μm and dried, in this order. Thus, a photoreceptor No. 57 including a charge transport layer having a thickness of 20 μm and a charge generation layer having a thickness of 0.1 μm was prepared.

The photoreceptor No. 57 was evaluated in the same way as the photoreceptor No. 53 in Example 53. The evaluation results are shown in Table 13.

| (Composition of Charge Transport Layer Coating Liquid) | |
|---|---|
| Bisphenol A polycarbonate (PANLITE C-1400 from Teijin Chemicals Ltd.) | 10 parts |
| Toluene | 100 parts |
| Naphthalenetetracarboxylic acid diimide derivative compound No. 7 | 10 parts |

| (Composition of Charge Generation Layer Coating Liquid) | |
|---|---|
| Polyvinyl butyral (XYHL from UCC) | 0.5 parts |
| Cyclohexanone | 200 parts |
| Methyl ethyl ketone | 80 parts |
| X-type metal-free phthalocyanine (FASTOGEN BLUE 8120B from DIC Corporation) | 2 parts |

Examples 58 to 60

The procedure for preparation and evaluation of the photoreceptor No. 57 in Example 57 was repeated except that the naphthalenetetracarboxylic acid diimide derivative compound No. 7 was replaced with the compounds described in Table 13, respectively. Thus, photoreceptors Nos. 58 to 60 were prepared. The evaluation results are shown in Table 13.

TABLE 13

| | | | Initial stage | | After printing 100,000 sheets | |
|---|---|---|---|---|---|---|
| Ex. | Photoreceptor No. | Compound No. | Bright Section Potential (V) | Dot Resolution | Bright Section Potential (V) | Dot Resolution |
| 57 | 57 | 7 | −100 | 5 | −115 | 5 |
| 58 | 58 | 9 | −100 | 5 | −115 | 5 |
| 59 | 59 | 17 | −110 | 5 | −120 | 5 |
| 60 | 60 | 25 | −105 | 5 | −110 | 5 |

Comparative Example 1

The procedure for preparation and evaluation of the photoreceptor No. 1 in Example 1 was repeated except that the naphthalenetetracarboxylic acid diimide derivative compound No. 4 was replaced with a benzoquinone derivative having the following formula:

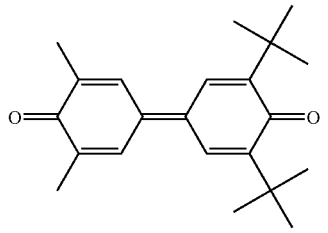

Thus, a comparative photoreceptor No. 1 was prepared. The evaluation results are shown in Table 14.

Comparative Example 2

The procedure for preparation and evaluation of the photoreceptor No. 16 in Example 16 was repeated except that no naphthalenetetracarboxylic acid diimide derivative was added to the charge transport layer coating liquid and the amount of the charge transport material was changed to 10 parts. Thus, a comparative photoreceptor No. 2 was prepared. The evaluation results are shown in Table 14.

Comparative Example 3

The procedure for preparation and evaluation of the photoreceptor No. 35 in Example 35 was repeated except that the naphthalenetetracarboxylic acid diimide derivative was replaced with a tetraphenylmethane compound (disclosed in JP-A 2000-231204) having the following formula:

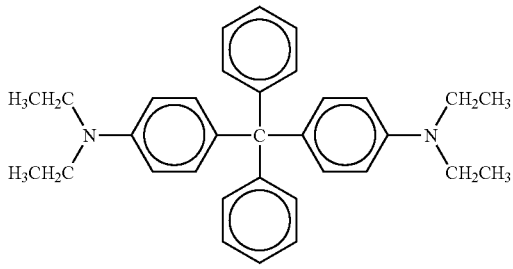

Thus, a comparative photoreceptor No. 3 was prepared. The evaluation results are shown in Table 14.

Comparative Example 4

The procedure for preparation and evaluation of the photoreceptor No. 47 in Example 47 was repeated except that the naphthalenetetracarboxylic acid diimide derivative was replaced with a hindered amine antioxidant having the following formula:

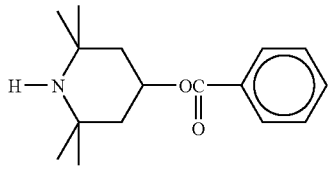

Thus, a comparative photoreceptor No. 4 was prepared. The evaluation results are shown in Table 14.

Comparative Example 5

The procedure for preparation and evaluation of the photoreceptor No. 49 in Example 49 was repeated except that 20 parts of the naphthalenetetracarboxylic acid diimide derivative compound No. 7 was replaced with 18 parts of a charge transport material CTM5 and 2 parts of a charge transport material CTM6 each having the following formulae:

(CTM5)

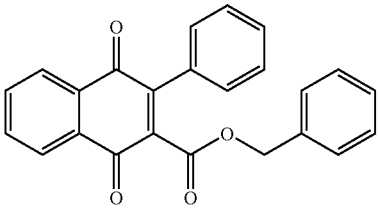

(CTM6)

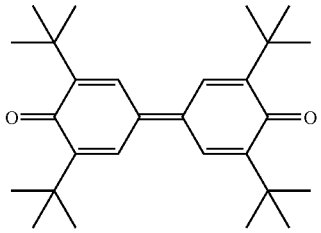

Thus, a comparative photoreceptor No. 5 was prepared. The evaluation results are shown in Table 14.

Comparative Example 6

The procedure for preparation and evaluation of the photoreceptor No. 57 in Example 57 was repeated except that 10 parts of the naphthalenetetracarboxylic acid diimide derivative compound No. 7 was replaced with 9 parts of a charge transport material CTM7 and 1 part of a charge transport material CTM8 each having the following formulae:

(CTM7)

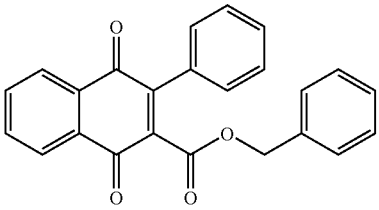

(CTM8)

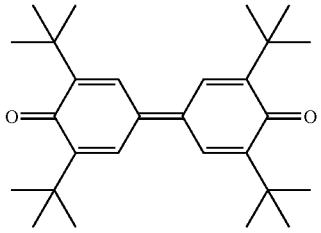

Thus, a comparative photoreceptor No. 6 was prepared. The evaluation results are shown in Table 14.

TABLE 14

| | | Initial stage | | After printing 100,000 sheets | |
|---|---|---|---|---|---|
| Comp. Ex. | Photoreceptor No. | Bright Section Potential (V) | Dot Resolution | Bright Section Potential (V) | Dot Resolution |
| 1 | Comp. 1 | +250 | 3 | +440 | 1 |
| 2 | Comp. 2 | −100 | 5 | −135 | 2 |
| 3 | Comp. 3 | −200 | 4 | −285 | 3 |

TABLE 14-continued

| | | Initial stage | | After printing 100,000 sheets | |
|---|---|---|---|---|---|
| Comp. Ex. | Photoreceptor No. | Bright Section Potential (V) | Dot Resolution | Bright Section Potential (V) | Dot Resolution |
| 4 | Comp. 4 | −250 | 2 | −480 | 1 |
| 5 | Comp. 5 | +105 | 5 | +145 | 1 |
| 6 | Comp. 6 | −100 | 4 | −120 | 1 |

It is apparent from these results that the photoreceptors of the present invention including a naphthalenetetracarboxylic acid diimide derivative have a low bright section potential even after producing 100,000 sheets of an image. That is to say, the photoreceptor of the present invention stably produces high quality images.

In contrast, the comparative photoreceptors 1, 3, and 4 inherently have a high bright section potential. Therefore, the resultant image has poor dot resolution. In particular, the $100{,}000^{th}$ or later image cannot be determined.

Furthermore, it is apparent from Tables 2 and 11 that the photoreceptors of the present invention can produce high quality images in a case in which the photoreceptor is positively charged, even after producing 100,000 sheets of an image.

The comparative photoreceptors 2, 5, and 6 have a relatively low bright section potential even after producing 100,000 sheets of an image, however, resolution of the resultant image greatly deteriorates by repeated use.

Examples 61 to 67 and Comparative Example 7

The photoreceptors and comparative photoreceptor described in Table 15 were left in a desiccator filled with 50 ppm of nitrogen oxide (NOx) gases for 4 days. Images produced before and after the photoreceptors have been left in the desiccator were evaluated. The evaluation results are shown in Table 15.

TABLE 15

| | | Image Quality | |
|---|---|---|---|
| | Photoreceptor No. | Before | After |
| Example 61 | 1 | 5 | 5 |
| Example 62 | 17 | 5 | 4 |
| Example 63 | 33 | 5 | 5 |
| Example 64 | 37 | 5 | 4 |
| Example 65 | 48 | 5 | 5 |
| Example 66 | 49 | 5 | 4 |
| Example 67 | 59 | 5 | 4 |
| Comparative Example 7 | Comparative 2 | 5 | 1 |

It is apparent from Table 15 that the photoreceptors of the present invention including a naphthalenetetracarboxylic acid diimide derivative produce high-resolution image even after exposed to oxidizing gases, i.e., the photoreceptors of the present invention have good resistance to oxidizing gases. In contrast, the comparative photoreceptor 2 produces low-resolution image after exposed to oxidizing gases.

This document claims priority and contains subject matter related to Japanese Patent Applications Nos. 2007-147718 and 2008-118020, filed on Jun. 4, 2007 and Apr. 30, 2008, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

a conductive substrate; and a photosensitive layer located overlying the conductive substrate, comprising a naphthalenetetracarboxylic acid diimide derivative having the following formula (1):

(1)

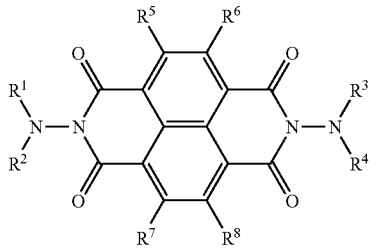

wherein each of $R^1$, $R^2$, $R^3$, and $R^4$ independently represents a substituted or unsubstituted alkyl group or a substituted or unsubstituted aromatic hydrocarbon group; each of $R^5$, $R^6$, $R^7$, and $R^8$ independently represents a hydrogen atom, a substituted or unsubstituted alkyl group, or a substituted or unsubstituted aromatic hydrocarbon group; wherein $R^1$ and $R^2$ do not share bond connectivity to form a substituted or unsubstituted heterocyclic group containing a nitrogen atom; and $R^3$ and $R^4$ do not share bond connectivity to form a substituted or unsubstituted heterocyclic group containing a nitrogen atom.

2. The electrophotographic photoreceptor according to claim 1, wherein the photosensitive layer comprises:

a charge generation layer; and a charge transport layer located overlying the charge generation layer.

3. The electrophotographic photoreceptor according to claim 1, wherein the photosensitive layer comprises:

a charge transport layer; and a charge generation layer located overlying the charge transport layer.

4. The electrophotographic photoreceptor according to claim 1, wherein the photosensitive layer is single-layered.

5. The electrophotographic photoreceptor according to claim 1, wherein the photosensitive layer further comprises a charge transport material.

6. The electrophotographic photoreceptor according to claim 5, wherein the charge transport material comprises a stilbene derivative having the following formula (2):

(2)

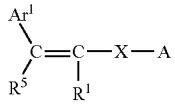

wherein X represents a single bond or a vinylene group; $R^1$ represents a hydrogen atom, a substituted or unsubstituted alkyl group, or a substituted or unsubstituted aromatic hydrocarbon group; $Ar^1$ represents a substituted or unsubstituted aromatic hydrocarbon group; $R^5$ represents a substituted or unsubstituted alkyl group or a substituted or unsubstituted aromatic hydrocarbon group; $Ar^1$ and $R^5$ may optionally share bond connectivity to form a ring; and A represents a group having the following formulae (3) or (4), a 9-anthryl group, or a substituted or unsubstituted carbazolyl group:

(3)

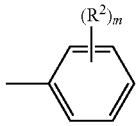

(4)

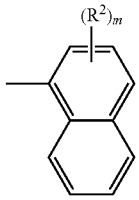

wherein $R^2$ represents a hydrogen atom, an alkyl group, an alkoxy group, a halogen atom, or a group having the following formula (5); m represents an integer of from 1 to 3; and when m is 2 or 3, multiple $R^2$ may be, but need not necessarily be, the same:

(5)

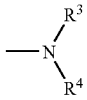

wherein each of $R^3$ and $R^4$ independently represents a substituted or unsubstituted alkyl group or a substituted or unsubstituted aromatic hydrocarbon group; and $R^3$ and $R^4$ may optionally share bond connectivity to form a ring.

7. The electrophotographic photoreceptor according to claim 5, wherein the charge transport material comprises an aminobiphenyl derivative having the following formula (6):

(6)

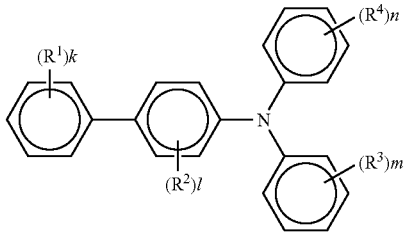

wherein each of $R^1$, $R^3$, and $R^4$ independently represents a hydrogen atom, an amino group, an alkoxy group, a thioalkoxy group, an aryloxy group, a methylenedioxy group, a substituted or unsubstituted alkyl group, a halogen atom, or a substituted or unsubstituted aromatic hydrocarbon group; $R^2$ represents a hydrogen atom, an alkoxy group, a substituted or unsubstituted alkyl group, or a halogen atom; each of k, l, m, and n independently represents an integer of from 1 to 4; and when k, l, m, and n each are 2, 3, or 4, multiple $R^1$, $R^2$, $R^3$, and $R^4$ each may be, but need not necessarily be, the same.

8. The electrophotographic photoreceptor according to claim 5, wherein the charge transport material comprises a distilbene derivative having the following formula (7):

(7)

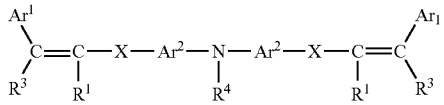

wherein X represents a single bond or a vinylene group; $R^1$ represents a hydrogen atom, a substituted or unsubstituted alkyl group, or a substituted or unsubstituted aromatic hydrocarbon group; $Ar^1$ represents a substituted or unsubstituted aromatic hydrocarbon group; $R^3$ represents a substituted or unsubstituted alkyl group or a substituted or unsubstituted aromatic hydrocarbon group; $Ar^1$ and $R^3$ may optionally share bond connectivity to form a ring; $R^4$ represents a substituted or unsubstituted alkyl group or a substituted or unsubstituted aromatic hydrocarbon group; and $Ar^2$ represents a group having the following formulae (8) or (9):

(8)

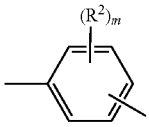

(9)

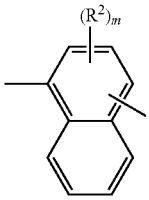

wherein $R^2$ represents a hydrogen atom, an alkyl group, an alkoxy group, or a halogen atom; m represents an integer of from 1 to 3; and when m is 2 or 3, multiple $R^2$ may be, but need not necessarily be, the same.

9. The electrophotographic photoreceptor according to claim 5, wherein the charge transport material comprises a divinyl derivative having the following formula (10):

(10)

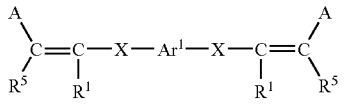

wherein X represents a single bond or a vinylene group; $R^1$ represents a hydrogen atom, a substituted or unsubstituted alkyl group, or a substituted or unsubstituted aromatic hydrocarbon group; $Ar^1$ represents a substituted or unsubstituted divalent aromatic hydrocarbon group; $R^5$ represents a substituted or unsubstituted alkyl group or a substituted or unsubstituted aromatic hydrocarbon group; and A represents a group having the following formulae (3) or (4), a 9-anthryl group, or a substituted or unsubstituted carbazolyl group:

(3)

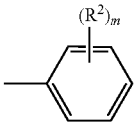

(4)

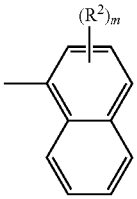

wherein $R^2$ represents a hydrogen atom, an alkyl group, an alkoxy group, a halogen atom, or a group having the following formula (5); m represents an integer of from 1 to 3; and when m is 2 or 3, multiple $R^2$ may be, but need not necessarily be, the same:

(5)

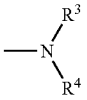

wherein each of $R^3$ and $R^4$ independently represents a substituted or unsubstituted alkyl group or a substituted or unsubstituted aromatic hydrocarbon group; and $R^3$ and $R^4$ may optionally share bond connectivity to form a ring.

10. An image forming apparatus, comprising:

the electrophotographic photoreceptor according to claim 1;

a charger configured to charge the electrophotographic photoreceptor;

an irradiator configured to irradiate the charged electrophotographic photoreceptor to form an electrostatic latent image thereon;

a developing device configured to develop the electrostatic latent image with a toner to form a toner image; and a transfer device configured to transfer the toner image onto a recording medium.

11. The image forming apparatus according to claim 10, wherein the irradiator comprises a laser diode or a light-emitting diode.

12. The image forming apparatus according to claim 10, wherein the photosensitive layer comprises:

a charge generation layer; and a charge transport layer located overlying the charge generation layer.

13. The image forming apparatus according to claim 10, wherein the photosensitive layer comprises:

a charge transport layer; and a charge generation layer located overlying the charge transport layer.

14. The image forming apparatus according to claim 10, wherein the photosensitive layer is single-layered.

15. The image forming apparatus according to claim 10, wherein the photosensitive layer further comprises a charge transport material.

16. A process cartridge, comprising:

the electrophotographic photoreceptor according to claim 1; and at least one of a charger, an irradiator, a developing device, and a cleaning device.

17. The process cartridge according to claim 16, wherein the photosensitive layer comprises:

a charge generation layer; and a charge transport layer located overlying the charge generation layer.

18. The process cartridge according to claim 16, wherein the photosensitive layer comprises:

a charge transport layer; and a charge generation layer located overlying the charge transport layer.

19. The process cartridge according to claim 16, wherein the photosensitive layer is single-layered.

20. The process cartridge according to claim 16, wherein the photosensitive layer further comprises a charge transport material.

* * * * *